US010818231B2

(12) United States Patent
Chaji

(10) Patent No.: US 10,818,231 B2
(45) Date of Patent: Oct. 27, 2020

(54) PIXEL CIRCUITS INCLUDING FEEDBACK CAPACITORS AND RESET CAPACITORS, AND DISPLAY SYSTEMS THEREFORE

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 16/540,201

(22) Filed: Aug. 14, 2019

(65) Prior Publication Data

US 2019/0371242 A1 Dec. 5, 2019

Related U.S. Application Data

(63) Continuation of application No. 15/661,777, filed on Jul. 27, 2017, now Pat. No. 10,424,245, which is a (Continued)

(51) Int. Cl.
*G09G 3/30* (2006.01)
*G09G 3/32* (2016.01)
(Continued)

(52) U.S. Cl.
CPC ..... *G09G 3/3233* (2013.01); *G09G 3/3208* (2013.01); *G09G 3/3258* (2013.01); *G09G 3/3283* (2013.01); *G09G 3/325* (2013.01); *G09G 3/3291* (2013.01); *G09G 2300/0819* (2013.01); *G09G 2300/0852* (2013.01); *G09G 2300/0861* (2013.01); *G09G 2310/061* (2013.01); *G09G 2310/066* (2013.01)

(58) Field of Classification Search
CPC .... G09G 3/3233; G09G 3/3283; G09G 3/325; G09G 3/3291; G09G 2300/0819; G09G 2300/0852; G09G 2310/061; G09G 2310/0251; G09G 2310/0272; G09G 2320/043
See application file for complete search history.

(56) References Cited

U.S. PATENT DOCUMENTS

2002/0130827 A1* 9/2002 Maurice ..... G09G 3/2011 345/76
2005/0212787 A1* 9/2005 Noguchi ..... G09G 3/3233 345/204
(Continued)

*Primary Examiner* — Michael J Eurice
(74) *Attorney, Agent, or Firm* — Stratford Managers Corporation

(57) ABSTRACT

A display with a pixel circuit for driving a current-driven emissive element includes a feedback capacitor in series between the emissive element and a programming node of the pixel circuit. During driving, variations in the operating voltage of the emissive element due to variations in the current conveyed through the emissive element by a driving transistor are accounted for. The feedback capacitor generates voltage adjustments at the programming node that correspond to the variations at the emissive element, and thus reduces variations in light emission. A reset capacitor connected to a select line is selectively connected to the gate terminal of the driving transistor and resets the driving transistor prior to programming. The select line adjusts the voltage on the gate terminal to reset the driving transistor by the capacitive coupling of the select line to the gate terminal created by the reset capacitor.

20 Claims, 18 Drawing Sheets

Related U.S. Application Data continuation of application No. 13/470,059, filed on May 11, 2012, now Pat. No. 9,747,834.

(51) Int. Cl.

| | |
|---|---|
| ***G09G 3/3233*** | (2016.01) |
| ***G09G 3/3283*** | (2016.01) |
| ***G09G 3/3208*** | (2016.01) |
| ***G09G 3/3258*** | (2016.01) |
| *G09G 3/325* | (2016.01) |
| *G09G 3/3291* | (2016.01) |

(56) References Cited

U.S. PATENT DOCUMENTS

2006/0066528 A1* 3/2006 Hara ..... G09G 3/325 345/76
2008/0143651 A1* 6/2008 Choi ..... G09G 3/3258 345/76
2008/0252217 A1* 10/2008 Kim ..... G09G 3/3233 315/51
2009/0021536 A1* 1/2009 Abe ..... G09G 3/325 345/690
2009/0219232 A1* 9/2009 Choi ..... G09G 3/3233 345/76
2010/0079419 A1* 4/2010 Shibusawa ..... H01L 27/3272 345/204
2011/0025586 A1* 2/2011 Lee ..... G09G 3/3266 345/76
2011/0084993 A1* 4/2011 Kawabe ..... G09G 3/3233 345/691
2011/0279049 A1* 11/2011 Kawabe ..... G09G 3/3233 315/228
2012/0306840 A1* 12/2012 Han ..... G09G 3/3233 345/212
2013/0201172 A1* 8/2013 Jeong ..... G09G 3/325 345/212
2015/0187276 A1* 7/2015 Shim ..... G09G 3/3291 345/77
2016/0019835 A1* 1/2016 Han ..... G09G 3/3208 348/53

* cited by examiner

PIXEL CIRCUITS INCLUDING FEEDBACK CAPACITORS AND RESET CAPACITORS, AND DISPLAY SYSTEMS THEREFORE

CROSS-REFERENCE TO RELATED APPLICATIONS

This application is a continuation of U.S. patent application Ser. No. 15/661,777, filed Jul. 27, 2019, now allowed, which is a continuation of U.S. patent application Ser. No. 13/470,059, filed May 11, 2012, now U.S. Pat. No. 9,747,834, which is hereby incorporated by reference herein in its entirety.

FIELD OF THE INVENTION

The present disclosure generally relates to circuits and methods of driving, calibrating, and programming displays, particularly displays including emissive elements and drive transistors therefore such as active matrix organic light emitting diode displays.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. Displays including current-driven emissive devices may be operated by drive transistors in each pixel circuit connected in series with the emissive device to convey current through the emissive devices according to programming information. Storage capacitors may be included in each pixel circuit to receive a voltage based on the programming information and apply the voltage to the drive transistor. TFTs fabricated on poly-silicon tend to demonstrate non-uniform behavior across display panels and over time. Furthermore, emissive devices degrade over time and may require increasing applied voltage to maintain luminance levels, over time. Some displays therefore utilize compensation techniques to achieve image uniformity in TFT panels.

Compensated pixel circuits generally have shortcomings when pushing speed, pixel-pitch ("pixel density"), and uniformity to the limit, which leads to design trade-offs to balance competing demands amongst programming speed, pixel-pitch, and uniformity. For example, additional lines and transistors associated with each pixel circuit may allow for additional compensation leading to greater uniformity, yet undesirably decrease pixel density. In another example, programming speed may be increased by biasing or pre-charging each pixel circuit with a relatively high biasing current or initial charge, however, uniformity is enhanced by utilizing a relatively low biasing current or initial charge. Thus, a display designer is forced to make trade-offs between competing demands for programming speed, pixel-pitch, and uniformity.

Displays configured to display a video feed of moving images typically refresh the display at a regular frequency for each frame of the video feed being displayed. Displays incorporating an active matrix can allow individual pixel circuits to be programmed with display information during a program phase and then emit light according to the display information during an emission phase. The displays operate to program each pixel in the display during a timing budget based on the refresh rate of the display and the size of the display. The refresh rate of the display can also be influenced by the frame rate of the video stream.

BRIEF SUMMARY

Some embodiments of the present disclosure provide pixel circuits for display systems, and driving schemes therefore, where the pixel circuits are provided with one or more capacitors arranged to capacitively couple to a data node of the pixel circuits. The capacitors are used to regulate the voltage at the data node to receive programming information and/or account for dynamic instabilities in semi-conductive elements in the pixel circuits. In some examples, the data node is reset prior to programming the pixel circuit by adjusting a select line voltage that simultaneously turns on a switch transistor and capacitively couples the data node to the select line such that the voltage adjustment on the data line generates a corresponding voltage change at the data node. In some examples, a capacitor is provided to automatically adjust the data node during an emission operation to account for voltage instabilities and/or variations due to dynamic instabilities in the operation of semi-conductive elements in the pixel circuit, such as drive transistors and/or emissive elements.

In some embodiments of the present disclosure, a pixel circuit is disclosed. The pixel circuit can include a drive transistor, an emission control transistor, and a feedback capacitor. The drive transistor can include a gate terminal and be arranged to convey a drive current through a light emitting device. The drive current can be conveyed according to a voltage on the gate terminal. The emission control transistor can be connected in series between the drive transistor and the light emitting device. The feedback capacitor can be connected between the light emitting device and a gate terminal of the drive transistor such that voltage changes across the light emitting device generate corresponding voltage changes at the gate terminal of the drive transistor. Therefore, if the pixel current changes slightly due to any instability in the pixel elements, the voltage across the light emitting device (e.g., an OLED operating voltage) will change and so modify the gate voltage of the driver transistor through the feedback capacitor to restore the pixel current.

In some embodiments of the present disclosure, a display system including a plurality of pixel circuits arranged in rows and columns is provided. Each of the plurality of pixel circuits can include a drive transistor, an emission control transistor, and a feedback capacitor. The drive transistor can include a gate terminal and be arranged to convey a drive current through a light emitting device. The drive current can be conveyed according to a voltage on the gate terminal. The emission control transistor can be connected in series between the drive transistor and the light emitting device. The feedback capacitor can be connected between the light emitting device and a gate terminal of the drive transistor such that voltage changes across the light emitting device generate corresponding voltage changes at the gate terminal of the drive transistor.

In some embodiments of the present disclosure, a pixel circuit including a drive transistor, a first switch transistor, and a reset capacitor is disclosed. The drive transistor can include a gate terminal and can be arranged to convey a drive current through a light emitting device. The drive current can be conveyed according to a voltage on the gate terminal of the drive transistor. The first switch transistor can be connected between the gate terminal of the drive transistor and a node of the pixel circuit. The reset capacitor can be connected between the node and a reset line such that the reset line is capacitively coupled to the gate terminal of the drive transistor while the first switch transistor is turned on. In some embodiments, the reset line can optionally control the first switch transistor such that turning on the switch transistor by adjusting the voltage on the reset line simultaneously generates a change in voltage at the gate terminal of the drive transistor.

In some embodiments of the present disclosure, a method of operating a pixel circuit is disclosed. The pixel circuit can include a drive transistor, a reset capacitor, and a first switch transistor. The drive transistor can include a gate terminal and can be arranged to convey a drive current through a light emitting device. The drive current can be conveyed according to a voltage on the gate terminal. The capacitor can be connected to the gate terminal of the drive transistor for applying a voltage to the gate terminal according to programming information. The first switch transistor can be connected between the gate terminal of the drive transistor and a node of the pixel circuit. The reset capacitor can be connected between the node and a reset line such that the reset line is capacitively coupled to the gate terminal of the drive transistor while the first switch transistor is turned on. The method can include turning on the first switch transistor; adjusting the voltage on the reset line to generate a change in voltage at the gate terminal of the drive transistor via the capacitive coupling of the reset capacitor; programming the pixel circuit according to programming information; and driving the pixel circuit to emit light according to the programming information.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

FIG. 2 is a circuit diagram of an example pixel circuit configuration for a display that incorporates a feedback capacitor and.

Figure 1:
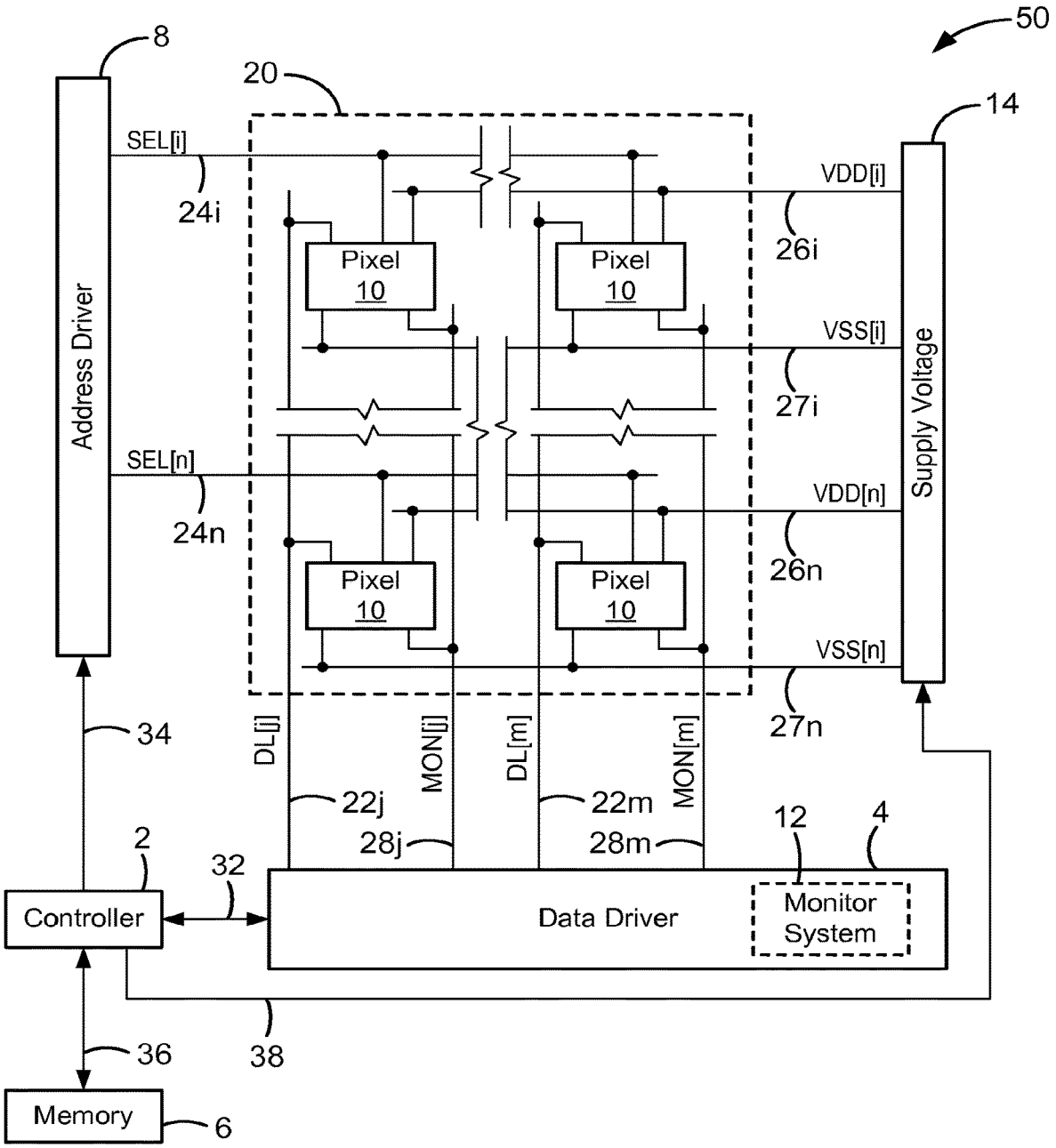
FIG. 1 is a diagram of an exemplary display system including includes an address driver, a data driver, a controller, a memory storage, and display panel.

While the present disclosure is susceptible to various modifications and alternative forms, specific embodiments and implementations have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the inventions as defined by the appended claims.

DETAILED DESCRIPTION

One or more currently preferred embodiments have been described by way of example. It will be apparent to persons skilled in the art that a number of variations and modifications can be made without departing from the scope of the invention as defined in the claims.

Embodiments of the present invention are described using a display system that may be fabricated using different fabrication technologies including, for example, but not limited to, amorphous silicon, poly silicon, metal oxide, conventional CMOS, organic, anon/micro crystalline semiconductors or combinations thereof. The display system includes a pixel that may have a transistor, a capacitor and a light emitting device. The transistor may be implemented in a variety of materials systems technologies including, amorphous Si, micro/nano-crystalline Si, poly-crystalline Si, organic/polymer materials and related nanocomposites, semiconducting oxides or combinations thereof. The capacitor can have different structure including metal-insulator-metal and metal-insulator-semiconductor. The light emitting device may be, for example, but not limited to, an organic light emitting diode ("OLED"). The display system may be, but is not limited to, an AMOLED display system.

In the description, "pixel circuit" and "pixel" may be used interchangeably. Each transistor may have a gate terminal and two other terminals (first and second terminals). In the description, one of the terminals (e.g., the first terminal) of a transistor may correspond to, but is not limited to, a drain terminal. The other terminal (e.g., the second terminal) of the transistor may correspond to, but is not limited to, a source terminal. The first terminal and second terminal can also refer to source and drain terminals, respectively.

FIG. 1 is a diagram of an exemplary display system 50. The display system 50 includes an address driver 8, a data driver 4, a controller 2, a memory storage 6, and a display panel 20. The display panel 20 includes an array of pixels 10 arranged in rows and columns. Each of the pixels 10 are individually programmable to emit light with individually programmable luminance values. The controller 2 receives digital data indicative of information to be displayed on the display panel 20 (such as a video stream). The controller 2 sends signals 32 to the data driver 4 and scheduling signals 34 to the address driver 8 to drive the pixels 10 in the display panel 20 to display the information indicated. The plurality of pixels 10 associated with the display panel 20 thus comprise a display array ("display screen") adapted to dynamically display information according to the input digital data received by the controller 2. The display screen can display, for example, video information from a stream of video data received by the controller 2. The supply voltage 14 can provide constant power voltage(s) or can be an adjustable voltage supply that is controlled by signals 38 from the controller 2. The display system 50 can also include pixel circuits (e.g., any of the pixels 10) including feedback capacitors (e.g., the feedback capacitors discussed in connection with FIGS. 2-5B) to account for voltage variations in emissive elements within the pixels 10. Additionally or alternatively, the display system 50 can include pixel circuits (e.g., any of the pixels 10) including reset capacitors (e.g., the reset capacitors discussed in connection with FIGS. 6A-10) to reset the drive transistor and its associated storage capacitor between programming events via capacitive coupling between the reset capacitor and an address select line and/or reset line.

For illustrative purposes, the display system 50 in FIG. 1 is illustrated with only four pixels 10 in the display panel 20. It is understood that the display system 50 can be implemented with a display screen that includes an array of similar pixels, such as the pixels 10, and that the display screen is not limited to a particular number of rows and columns of pixels. For example, the display system 50 can be implemented with a display screen with a number of rows and columns of pixels commonly available in displays for mobile devices, monitor-based devices, and/or projection-devices.

The pixel 10 is operated by a driving circuit ("pixel circuit") that generally includes a driving transistor and a light emitting device. Hereinafter the pixel 10 may refer to the pixel circuit. The light emitting device can optionally be an organic light emitting diode, but implementations of the present disclosure apply to pixel circuits having other electroluminescence devices, including current-driven light emitting devices. The driving transistor in the pixel 10 can include thin film transistors ("TFTs"), which an optionally be n-type or p-type amorphous silicon TFTs or poly-silicon TFTs. However, implementations of the present disclosure are not limited to pixel circuits having a particular polarity or material of transistor or only to pixel circuits having TFTs. The pixel circuit 10 can also include a storage capacitor for storing programming information and allowing the pixel circuit 10 to drive the light emitting device after being addressed. Thus, the display panel 20 can be an active matrix display array.

As illustrated in FIG. 1, the pixel 10 illustrated as the top-left pixel in the display panel 20 is coupled to a select line 24*i*, supply line 26*i*, 27*i*, a data line 22*j*, and a monitor line 28*j*. The first supply line 26*i* can be charged with VDD and the second supply line 27*i* can be charged with VSS. The pixel circuits 10 can be situated between the first and second supply lines to allow driving currents to flow between the two supply lines 26*i*, 27*i* during an emission cycle of the pixel circuit. The top-left pixel 10 in the display panel 20 can correspond to a pixel in the display panel in an "ith" row and "jth" column of the display panel 20. Similarly, the top-right pixel 10 in the display panel 20 represents an "ith" row and "mth" column; the bottom-left pixel 10 represents an "nth" row and "jth" column; and the bottom-right pixel 10 represents an "nth" row and "mth" column. Each of the pixels 10 is coupled to appropriate select lines (e.g., the select lines 24*i* and 24*n*), supply lines (e.g., the supply lines 26*i*, 26*n*, and 27*i*, 27*n*), data lines (e.g., the data lines 22*j* and 22*m*), and monitor lines (e.g., the monitor lines 28*j* and 28*m*). It is noted that aspects of the present disclosure apply to pixels having additional connections, such as connections to additional select lines, including global select lines, and to pixels having fewer connections, such as pixels lacking a connection to a monitoring line.

With reference to the top-left pixel 10 shown in the display panel 20, the select line 24*i* is provided by the address driver 8, and can be utilized to enable, for example, a programming operation of the pixel 10 by activating a switch or transistor to allow the data line 22*j* to program the pixel 10. The data line 22*j* conveys programming information from the data driver 4 to the pixel 10. For example, the data line 22*j* can be utilized to apply a programming voltage or a programming current to the pixel 10 in order to program the pixel 10 to emit a desired amount of luminance. The programming voltage (or programming current) supplied by the data driver 4 via the data line 22*j* is a voltage (or current) appropriate to cause the pixel 10 to emit light with a desired amount of luminance according to the digital data received by the controller 2. The programming voltage (or programming current) can be applied to the pixel 10 during a programming operation of the pixel 10 so as to charge a storage device within the pixel 10, such as a storage capacitor, thereby enabling the pixel 10 to emit light with the desired amount of luminance during an emission operation following the programming operation. For example, the storage device in the pixel 10 can be charged during the programming operation to apply a voltage to one or more of a gate or a source terminal of the driving transistor during the emission operation, thereby causing the driving transistor to convey the driving current through the light emitting device according to the voltage stored on the storage device.

Generally, in the pixel 10, the driving current that is conveyed through the light emitting device by the driving transistor during the emission operation of the pixel 10 is a current that is supplied by the first supply line 26*i* and is drained to the second supply line 27*i*. The first supply line 26*i* and the second supply line 27*i* are coupled to the voltage supply 14. The first supply line 26*i* can provide a positive supply voltage (e.g., the voltage commonly referred to in circuit design as "Vdd") and the second supply line 27*i* can provide a negative supply voltage (e.g., the voltage commonly referred to in circuit design as "Vss"). Implementations of the present disclosure can be realized where one or the other of the supply lines (e.g., the supply lines 26*i*, 27*i*) are fixed at a ground voltage or at another reference voltage. Implementations of the present disclosure also apply to systems where the voltage supply 14 is implemented to adjustably control the voltage levels provided on one or both of the supply lines (e.g., the supply lines 26*i*, 27*i*). The output voltages of the voltage supply 14 can be dynamically adjusted according to control signals 38 from the controller 2. Implementations of the present disclosure also apply to systems where one or both of the voltage supply lines 26*i*, 27*i* are shared by more than one row of pixels in the display panel 20.

The display system 50 also includes a monitoring system 12. With reference again to the top left pixel 10 in the display panel 20, the monitor line 28*j* connects the pixel 10 to the monitoring system 12. The monitoring system 12 can be integrated with the data driver 4, or can be a separate stand-alone system. Furthermore, the monitoring system 12 can optionally be implemented by monitoring the current and/or voltage of the data line 22*j* during a monitoring operation of the pixel 10, and the monitor line 28*j* can be entirely omitted. Additionally, the display system 50 can be implemented without the monitoring system 12 or the monitor line 28*j*. The monitor line 28*j* allows the monitoring system 12 to measure a current and/or voltage associated with the pixel 10 and thereby extract information indicative of a degradation of the pixel 10. For example, the monitoring system 12 can extract, via the monitor line 28*j*, a current flowing through the driving transistor within the pixel 10 and thereby determine, based on the measured current and based on the voltages applied to the driving transistor during the measurement, a threshold voltage of the driving transistor or a shift thereof. Furthermore, a voltage extracted via the monitoring lines 28*j*, 28*m* can be indicative of degradation in the respective pixels 10 due to changes in the current-voltage characteristics of the pixels 10 or due to shifts in the operating voltages of light emitting devices situated within the pixels 10.

The monitoring system 12 can also extract an operating voltage of the light emitting device (e.g., a voltage drop across the light emitting device while the light emitting device is operating to emit light). The monitoring system 12 can then communicate the signals 32 to the controller 2 and/or the memory 6 to allow the display system 50 to store the extracted degradation information in the memory 6. During subsequent programming and/or emission operations of the pixel 10, the degradation information is retrieved from the memory 6 by the controller 2 via the memory signals 36, and the controller 2 then compensates for the extracted degradation information in subsequent programming and/or emission operations of the pixel 10. For example, once the degradation information is extracted, the programming information conveyed to the pixel 10 during a subsequent programming operation can be appropriately adjusted such that the pixel 10 emits light with a desired amount of luminance that is independent of the degradation of the pixel 10. For example, an increase in the threshold voltage of the driving transistor within the pixel 10 can be compensated for by appropriately increasing the programming voltage applied to the pixel 10.

As will be described further herein, implementations of the current disclosure apply to systems that do not include separate monitor lines for each column of the display panel 20, such as where monitoring feedback is provided via a line used for another purpose (e.g., the data line 22*j*), or where compensation is accomplished within each pixel 10 without the use of an external compensation/monitoring system, or to combinations thereof.

Figure 2:
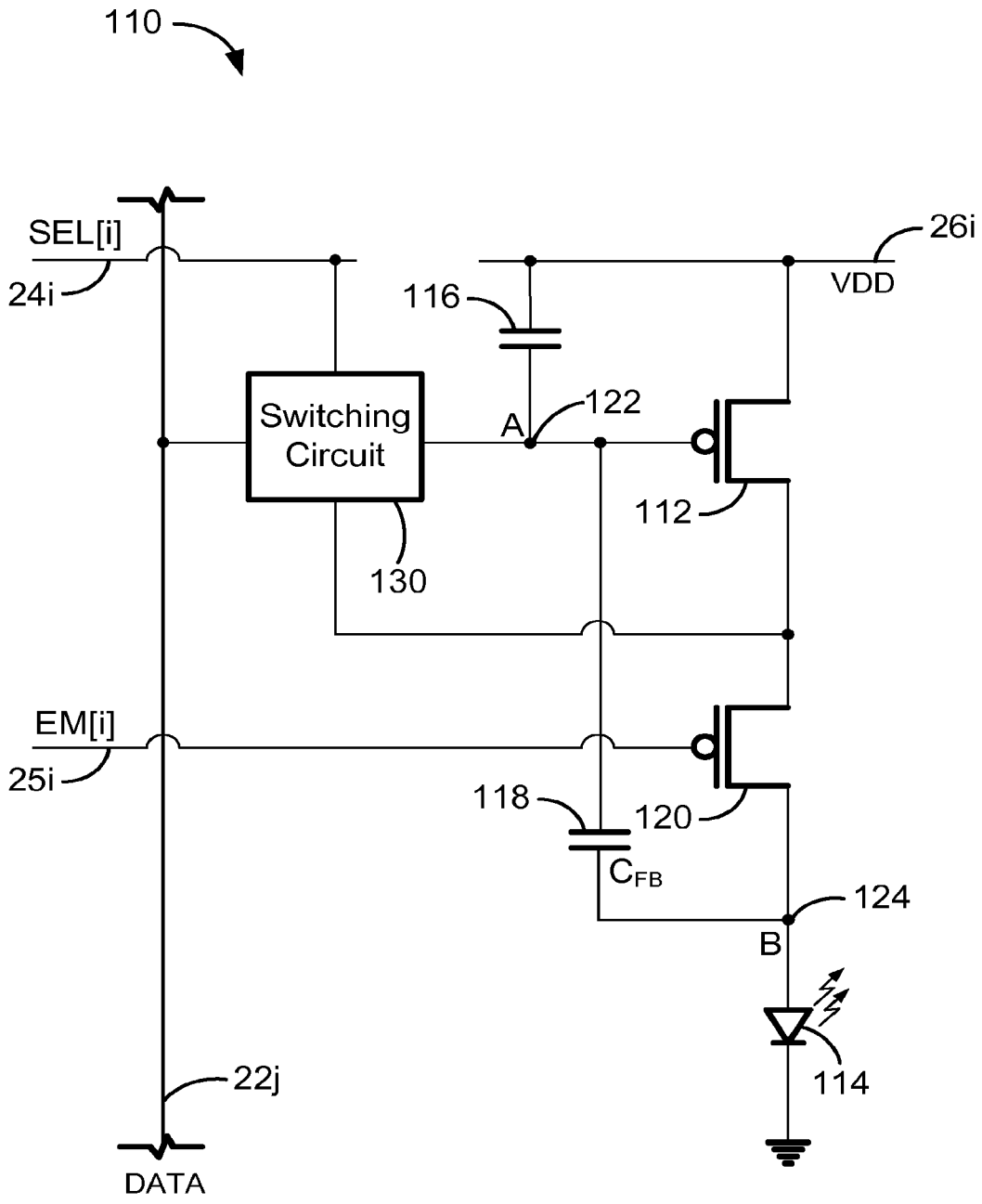

FIG. 2 is a circuit diagram of an example pixel circuit 110 configuration for a display that incorporates a feedback capacitor 118 and. The pixel circuit 110 can be implemented as the pixel 10 in the display system 50 shown in FIG. 1. The pixel circuit 110 includes a drive transistor 112 connected in series with a light emitting device 114. The light emitting device 114 can be a current-driven emissive element, such as, for example, an organic light emitting diode ("OLED"). The pixel circuit 110 also includes a storage capacitor 116 connected to the drive transistor 112 so as to influence the conductance of the channel region of the drive transistor 112 according to the voltage charged on the storage capacitor 116. In the configuration provided in FIG. 2, the storage capacitor 116 has a first terminal connected to the gate of the drive transistor 112 at node A 122 and a second terminal connected to the $V_{DD}$ power supply line 26*i*. In some embodiments the second terminal of the storage capacitor 116 can optionally be connected to another stable voltage (e.g., a ground voltage, a reference voltage, etc.) sufficient to allow the storage capacitor 116 to be charged according to programming voltages conveyed via the data line 22*j*.

An emission control transistor 120 is connected in series between the drive transistor 112 and the light emitting device 114. The emission control transistor 120 is situated to prevent the light emitting device 114 from receiving current (and thus emitting light) unless the emission control transistor 120 is turned on. The emission control transistor 120 is connected to an anode terminal of the light emitting device 114 at node B 124. The emission control transistor 120 is operated by an emission control line 25*i*, which is connected to the gate of the emission control transistor 120. In some examples, the emission control transistor is turned off during periods other than emission periods, such as during periods while the pixel circuit 110 is being programmed, for example, so as to prevent accidental emission from the pixel circuit 110 and thereby increase the contrast ratio of the resulting display panel (e.g., the panel 20 of the display system 50).

A switching circuit 130 is arranged between the data line 22*j* and the storage capacitor 116 (at node A 122) to selectively connect the data line 22*j* to the storage capacitor 116 to program the pixel circuit 110. The switching circuit 130 can include one or more switch transistors operating according to select lines (e.g., the select line 24*i* shown in FIG. 1) to provide the programming information on the data line 22*j* to the pixel circuit 110. Particular examples of the switching circuit are discussed further herein in connection with FIGS. 3A-5B.

A feedback capacitor 118 ("$C_{FB}$") is connected between node B 124 and node A 122. That is, the feedback capacitor 118 is connected between the anode terminal of the light emitting device 114 and the gate terminal of the drive transistor 112. The feedback capacitor 118 thus provides a capacitive coupling between the light emitting device 114 and the gate terminal of the drive transistor 112. For example, an increase in voltage at node B 124 (due to, for example, an increase in the turn on voltage of the light emitting device) results in a corresponding increase in voltage at node A via the capacitive coupling of the feedback capacitor 118. Furthermore, variations in the voltage of the anode terminal of the light emitting device 114 (at node B 124) during a driving operation produce corresponding voltage changes at the gate terminal of the drive transistor 112 (at node A 122). Changing the voltage at the gate terminal of the drive transistor 112 (at node A 122) also results in changes in the conveyed drive current, by modifying the conductance of the channel region of the drive transistor 112, which is established according to the voltage at the gate terminal of the drive transistor 112 and the current-voltage relationship of the drive transistor 112. Thus, some embodiments of the present disclosure provide for feedback to be provided to the drive transistor 112 to account for voltage variations on the light emitting device via the capacitive coupling provided by the feedback situated between node A 122 and node B 124.

In an exemplary operation of the pixel circuit 110, the emission control transistor 120 is turned off during a first cycle. Accordingly, the emission control line 25*i* is set high during the first cycle. During the first cycle, node B 124 is discharged to $V_{OLED}$(off) or to $V_{SS}+V_{OLED}$(off), where the cathode of the light emitting device 114 is connected to the $V_{SS}$ supply line 27*i* rather than ground. The voltage $V_{OLED}$ (off) is the off voltage of the light emitting device 114, e.g., the voltage across the light emitting device while no current is flowing through the light emitting device 114.

During a second cycle following the first cycle, the emission control transistor 120 is turned on via the emission control line 25*i* and the drive transistor 112 is driving the light emitting device 114 with a current $i_{DRIVE}$. The voltage of the light emitting device 114 increases to raise the voltage at node B 124 to $V_{OLED}(i_{DRIVE})$ (or to $V_{SS}+V_{OLED}(i_{DRIVE})$ where the cathode of the light emitting device 114 is connected to the $V_{SS}$ supply line 27*i*). The voltage $V_{OFED}$ ($i_{DRIVE}$) is the voltage of the light emitting device 114 for the current $i_{DRIVE}$ applied to the light emitting device 114 via the drive transistor 112. If the current of the drive transistor 112 varies, the voltage on the light emitting device 114 (i.e., the voltage at node B 124) will vary as well, because the voltage developed across the light emitting device 114 is generally dependent on the current being conveyed through it. As a result of the variation at node B 124, the feedback capacitor 118 will change the voltage at node A 122 according to equation 1 below.

$$\Delta V_A = \Delta V_B C_{FB}/(C_{FB}+C_S) \quad (1)$$

In equation 1, $C_{FB}$ is the capacitance of the feedback capacitor 118, CS is the capacitance of the storage capacitor 116, $\Delta V_B$ is the change in voltage at node B 124 (e.g., due to variations in the voltage of the light emitting device 114), and $\Delta V_A$ is the voltage change at node A 122 due to the capacitive coupling of the feedback capacitor 118. Thus, the adjustment to node A 122 via the feedback capacitor 118 acts as a feedback to bring the current of the drive transistor 112 (i.e., the current $i_{DRIVE}$) back to correct for the variations in the voltage on the light emitting device. For example, where the voltage of the light emitting device 114 increases at node B 124 (due to an increase in drive current arising from an instability in the drive transistor 112, for example), the feedback capacitor 118 raises the voltage at node A 122, which decreases the gate-source voltage on the drive transistor 112 and thus reduces the drive current to at least partially account for the increase.

In some examples, the first cycle while the emission control transistor 120 is turned off can be a programming cycle and the second cycle while the emission control transistor 120 is turned off can be an emission cycle. In some embodiments of the present disclosure, the feedback capacitor is arranged to automatically adjust the gate-source voltage of the drive transistor 112 during an emission operation to correct for instabilities in one or more elements of the pixel circuit 110 (e.g., the drive transistor 112 and/or light emitting device 114) and thereby provide a stable pixel current.

While the switching circuit 130 can generally be arranged according to particular implementations of the pixel circuit 110, exemplary configurations are provided in connection with FIGS. 3-5 below.

Figure 3A:
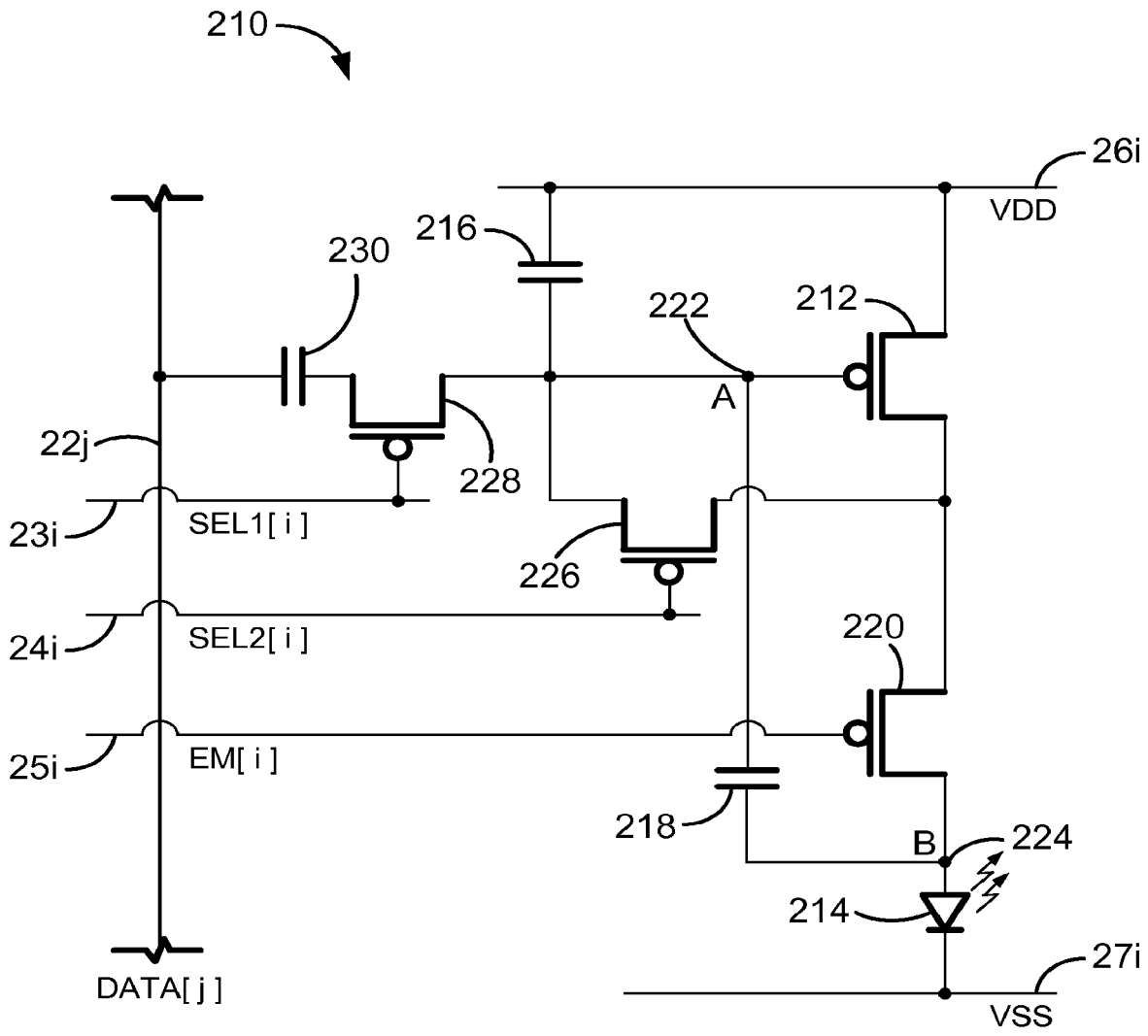
FIG. 3A is a circuit diagram with an exemplary switching circuitry arrangement for the pixel circuit represented in FIG. 2.

FIG. 3A is a circuit diagram of a pixel circuit 210 with an exemplary switching circuitry arrangement for the pixel circuit represented in FIG. 2. The pixel circuit 210 can be implemented as the pixel 10 in the display system 50 shown in FIG. 1, and can be one of a plurality of similar pixel circuits arranged in rows and columns to form a display panel, such as the display panel 20 described in connection with FIG. 1. However, it is noted that the pixel circuit 210 does not necessarily include the monitoring feedback line 28*j*. Furthermore, the pixel circuit 210 includes both a first select line 23*i* ("SEL1"), a second select line 24*i* ("SEL2"), and an emission control line 25*i* ("EM"). The pixel circuit 210 includes a drive transistor 212 connected in series with a light emitting device 214. The light emitting device 214 can be a current-driven emissive element, such as, for example, an organic light emitting diode ("OLED").

The pixel circuit is configured to be programmed via a programming capacitor 230 ("Cprg") connected to a gate terminal of the drive transistor 212 at node A 222 via a first switch transistor 228. The pixel circuit 110 also includes a second switch transistor 226 connected to a terminal of the drive transistor 212 opposite the $V_{DD}$ supply line 26*i* (at a point between the drive transistor 212 and the emission control transistor 220). The first and second switch transistors 228, 226 are operated according to the first select line 23*i* and second select line 24*i*, respectively. A storage capacitor 216 is connected to the gate of the drive transistor 212 at node A 222 so as to influence the conductance of the channel region of the drive transistor 212 according to the voltage charged on the storage capacitor 216. The pixel circuit 210 also includes an emission control transistor 220 operated according to the emission control line 25*i* to disconnect the light emitting device 214 from the drive transistor 212 during periods other than an emission period to prevent incidental emission during programming and/or compensation operations. The drive transistor 212, emission control transistor 220, and the light emitting device 214 are connected in series such that while the emission control transistor 220 is turned on, current conveyed through the drive transistor 212 is also conveyed through the light emitting device 214.

The programming capacitor 230 is connected in series between the data line 22*j* and the first switch transistor 228. Thus, the first switch transistor 228 is connected between a first terminal of the programming capacitor 230 and a gate terminal of the drive transistor 212, while a second terminal of the programming capacitor 230 is connected to the data line 22*j*.

Certain transistors in the pixel circuit 210 provide functions similar in some respects to corresponding transistors in the pixel circuit 110. For example, in a manner similar to the drive transistor 112, the drive transistor 212 directs a current from the voltage supply line 26*i* from a first terminal (e.g., a source terminal) to a second terminal (e.g., a drain terminal) based on the voltage applied to the gate terminal by the storage capacitor 216. The current directed through the drive transistor 212 is conveyed through the light emitting device 214, which emits light according to the current flowing through it similar to the light emitting device 114. In a manner similar to the operation of the emission control transistor 120, the emission control transistor 220 selectively allows current flowing through the drive transistor to be directed to the light emitting device 214, and thereby increases a contrast ratio of the display by reducing accidental emissions of the light emitting device. Furthermore, similarly to the feedback capacitor 118, the feedback capacitor 218 provides capacitive coupling between node B 224 and node A 222 such that the voltage on the drive transistor 212 is automatically adjusted to at least partially account for voltage variations of the light emitting device 214 during an emission operation.

The second switch transistor 226 is operated by the second select line 24*i* to selectively connect the second terminal (e.g., drain terminal) of the drive transistor 212 to the gate terminal at node A 222. Thus, while the second switch transistor 226 is turned on, the second switch transistor 226 provides a current path is between the voltage supply line 26*i* to the gate terminal (at node A 222) through the drive transistor 212. While the second switch transistor 226 is turned on, the voltage on the gate terminal at node A 222 can thus adjust to a voltage corresponding to a current flowing through the drive transistor 212.

The first switch transistor 228 is operated by the first select line 23*i* to selectively connect the programming capacitor 230 to node A 222. Furthermore, the pixel circuit 210 includes the storage capacitor 216 connected between the gate terminal of the drive transistor 212 (at node A 222) and the $V_{DD}$ supply line 26*i*. The first switch transistor 228 allows for node A 222 to be isolated (i.e., not capacitively coupled) to the data line 22*j* during an emission operation of the pixel circuit 210. For example, the pixel circuit 210 can be operated such that the first selection transistor 226 is turned off so as to disconnect node A 222 from the data line 22*j* whenever the pixel circuit 210 is not undergoing a compensation operation or a programming operation. Additionally, during an emission operation of the pixel circuit 210, the storage capacitor 216 holds a voltage based on programming information and applies the voltage to the gate terminal of the drive transistor 212 to cause the drive transistor 212 to drive a current through the light emitting device 214 according to the programming information.

Figure 3B:
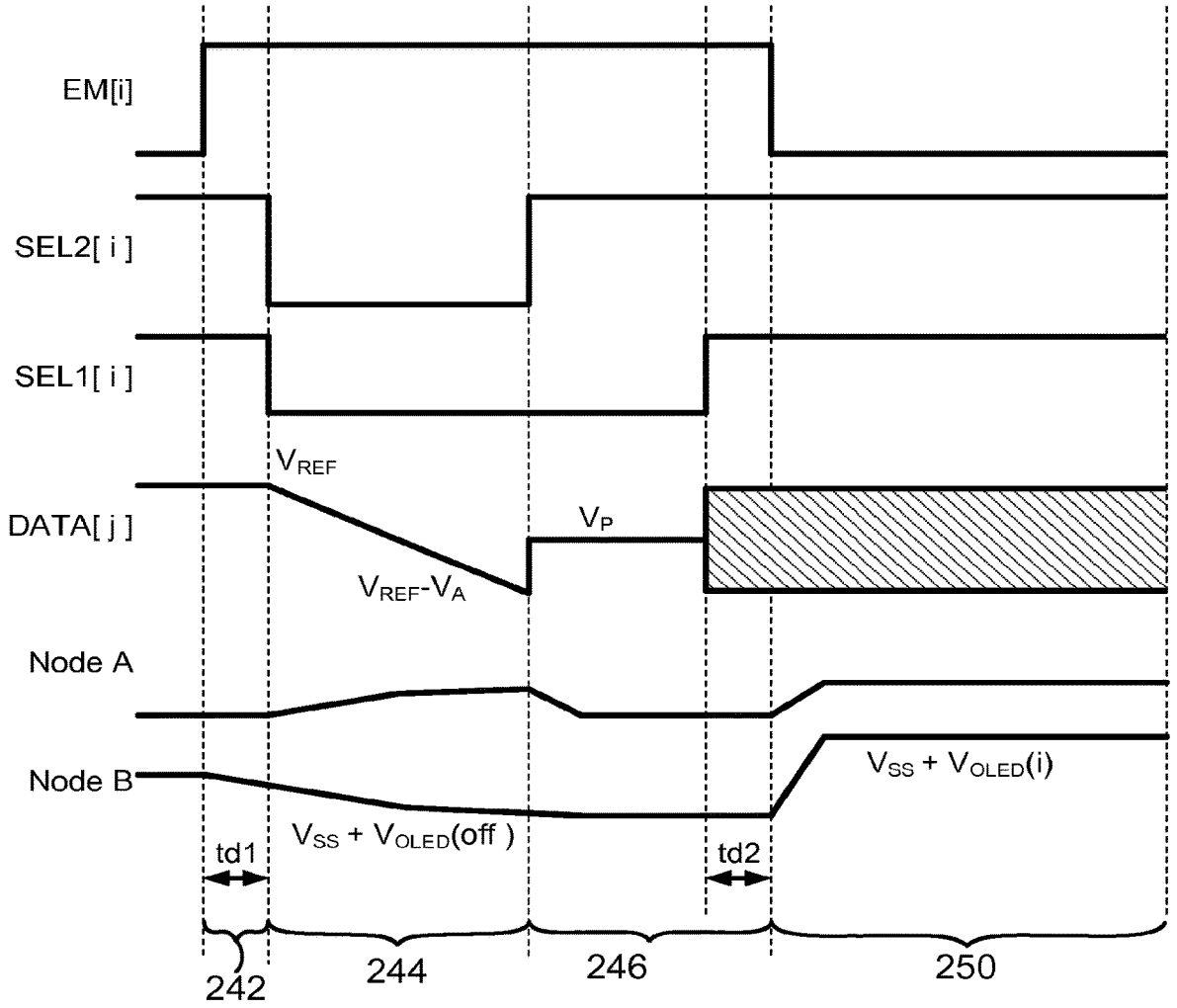
FIG. 3B is a timing diagram illustrating a programming and emission operation of the pixel circuit shown in FIG. 3A where the feedback capacitor automatically accounts for shifts in the operating voltage of the OLED.

FIG. 3B is a timing diagram illustrating an exemplary programming and emission operation of the pixel circuit shown in FIG. 3A where the feedback capacitor 218 automatically accounts for shifts in the operating voltage of the OLED 214. Operation of the pixel circuit 210 includes a compensation cycle 244, a program cycle 246, and an emission cycle 250 (alternately referred to herein as a driving cycle). The entire duration that the data line 22*j* is manipulated to provide compensation and programming to the pixel circuit 210 is a row period having a duration $t_{ROW}$ and includes both the compensation cycle 244 and the program cycle 246. The duration of $t_{ROW}$ can be determined based on the number of rows in the display panel 20 and the refresh rate of the display system 50. The row period is initiated by a first delay period 242, having duration td1. The first delay period 242 provides a transition time to allow the data line 22*j* to be reset from its previous programming voltage (for another row) and set to a reference voltage Vref suitable for commencing the compensation cycle 244. The duration td1 of the first delay period 242 is determined based on the response times of the transistors in the display system 50 and the number of rows in the display panel 20. The compensation cycle 244 is carried out during a time interval with duration $t_{COMP}$. The program cycle 246 is carried out during a time interval with duration $t_{PRG}$.

At the initiation of the row period the emission control line 25*i* ("EM") is set high to turn off the emission control transistor 220. Turning off the emission control transistor 220 during the row period reduces accidental emission form the light emitting device 214 while the pixel circuit 210 undergoes compensation and programming operations and thereby enhances contrast ratio. In addition, the voltage at node B 224 discharges to $V_{SS}+V_{OLED}$(off) during the period while the emission control line 25*i* is high and the emission control transistor 220 remains turned off.

Following the first delay period 242, the compensation cycle 244 is initiated. During the compensation cycle 244, the first and second select lines 23*i*, 24*i* are each set low at the start of the compensation cycle 244 so as turn on the first and second selection transistors 226, 228. The data line 22*j* ("DATA[j]") is set at a reference voltage $V_{REF}$, during the first delay period 242, and then changed at a substantially constant rate to $V_{REF}$-$V_A$. The voltage on the data line 22*j* is decreased by the voltage $V_A$. In some embodiments, the ramp voltage can be a voltage that decreases at a substantially constant rate (e.g., has a substantially constant time derivative) so as to generate a substantially constant current through the programming capacitor 230. The programming capacitor 230 thus provides a current that corresponds to the time changing ramp voltage applied on the data line 22*j*. The current across the programming capacitor 230 is conveyed through the drive transistor 212 via the second switch transistor 226 and the first switch transistor 228 during the compensation period 244. The amount of the current applied to the pixel circuit 210 via the programming capacitor 230 can be determined based on the voltage $V_A$, the duration $t_{RAMP}$, and the capacitance of the programming capacitor 230 ("Cprg"). The voltage that settles at node A 222 can be determined according to equation 2 below, where Iprg is the current across the programming capacitor 230, $V_A$ is the voltage at node A 222, and $V_{th}$ is the threshold voltage of the drive transistor 212. Equation 19 also includes variables relating to the device characteristics of the drive transistor 212: the mobility (μ), unit gate oxide ($C_{ox}$), and the aspect ratio of the device (W/L).

$$V_A = VDD - |V_{th}| - \sqrt{\frac{2Iprg}{\mu C_{ox} W/L}} \tag{2}$$

Thus the voltage at node A 222 at the conclusion of the compensation cycle 244 is a voltage that accounts for variations and/or degradations in transistor device parameters, such as degradations influencing the threshold voltage, mobility, oxide thickness, etc. of the drive transistor 212. At the conclusion of the compensation cycle, the second select line 24*i* is set high so as to turn off the second switch transistor 226. Once the second switch transistor 226, node A 222 is no longer adjusted according to current conveyed through the drive transistor 212.

Following the compensation cycle 244, the programming cycle 246 is initiated. During the programming cycle 246, the first select line 23*i* remains low so as to keep the first switch transistor 228 turned on. The emission line 25*i* and second select line 24*i* are set high to turn off the emission control transistor 220 and the second switch transistor 226. In some embodiments, the compensation cycle 244 and the programming cycle 246 can be briefly separated temporally by a delay time to allow the data line 22*j* to transition from conveying the ramp voltage to conveying a programming voltage. To isolate the pixel circuit 210 from any noise on the data line 22*j* generated during the transition, the first select line 23*i* can optionally go high briefly, during the delay time, so as to turn off the first switch transistor 417 during the transition. During the programming cycle 246, the data line 22*j* is set to a programming voltage $V_P$ and applied to the second terminal of the programming capacitor 230. The programming voltage $V_P$ is determined according to programming data indicative of an amount of light to be emitted from the light emitting device 214, and translated to a voltage based on a look-up table and/or formula that accounts for gamma effects, color corrections, device characteristics, circuit layout, etc.

While the programming voltage $V_P$ is applied to the second terminal of the programming capacitor 230, the voltage of node A 222 is adjusted due to the capacitive coupling of node A 222 with the data line 22*j*, through the first switch transistor 228 and the programming capacitor 230. An appropriate value for $V_P$ can be selected according to a function including the capacitances of the programming capacitor 230 and the storage capacitor 216 (i.e., the values Cprg and Cs) and the programming information. Because the programming information is conveyed through the capacitive coupling with the data line 22*j*, via the programming capacitor 230, DC voltages on node A 222 prior to initiation of the programming cycle 246 are not cleared. Rather, the voltage on node A 222 established during the compensation cycle 244 is adjusted during the programming cycle 246 so as to add (or subtract) from the voltage already on node A 222. Thus, the voltage that settles on node A 222 during the compensation cycle 244 ("Vcomp") is not cleared by the programming operation, because Vcomp acts as a DC voltage on node A 222 unaffected by the capacitive coupling with the data line 22*j*. The final voltage on node A 222 at the conclusion of the programming cycle 246 is thus an additive combination of Vcomp and a voltage based on $V_P$. The programming cycle concludes with the first select line 23*i* being set high so as to turn off the first selection transistor 228 and thereby disconnect the pixel circuit 210 from the data line 22*j*.

The emission cycle 250 is initiated by setting the emission control line 25*i* to a low voltage suitable to turn on the emission control transistor 220. The initiation of the driving cycle 460 can be separated from the termination of the programming cycle 246 by a second delay period td2 to allow some temporal separation between turning off the first selection transistor 228 and turning on the emission control transistor 220. The second delay period has a duration td2 determined based on the response times of the transistors 228 and 220.

Because the pixel circuit 410 is decoupled from the data line 22*j* during the emission cycle 250, the emission cycle 250 can be carried out independent of the voltage levels on the data line 22*j*. For example, the pixel circuit 210 can be operated in the emission mode while the data line 22*j* is operated to convey a voltage ramp (for compensation) and/or programming voltages (for programming) to other rows in the display panel 20 of the display system 50. In some embodiments, the time available for programming and compensation, (e.g., the values $t_{comp}$ and $t_{prog}$) are maximized by implementing the compensation and programming operations to each row in the display panel 20 one after another such that the data line 22*j* is substantially continuously driven to alternate between voltage ramps and programming voltages, which are applied to each sequentially. By allowing the emission cycle 250 to be carried out independently of the compensation and programming cycles 244, 246, the data line 22*j* is prevented from requiring wasteful idle time in which no programming or compensation is carried out.

During the emission cycle 250, variations in the voltage of the light emitting device 214, reflected in the voltage at node B 224 produce corresponding voltage changes at node A 222 via the capacitive coupling between node B 224 and node A 222 provided by the feedback capacitor 218. For example, an increased current through the light emitting device (due to, for example, instability in the drive transistor 212) generates an increased voltage at node B 224 due to the increased power dissipation in the light emitting device 214. The increased voltage at node B 224 causes a corresponding voltage increase at node A 222 according to the ratio shown in equation 1. The increase at node A 222 decreases the gate-source voltage on the drive transistor 222 and accordingly decreases the current through the light emitting device 214 to correct for the instability in the drive transistor 212 (or for instabilities in the light emitting device 214). Similarly, a voltage decrease at node B 224 generates a voltage decrease at node A 222, which increases the current conveyed to the light emitting device 214 by the drive transistor 212. Thus, the feedback capacitor 218 automatically accounts for instabilities in the drive transistor 212 and/or light emitting device 214 during the emission cycle 250.

Figure 4A:
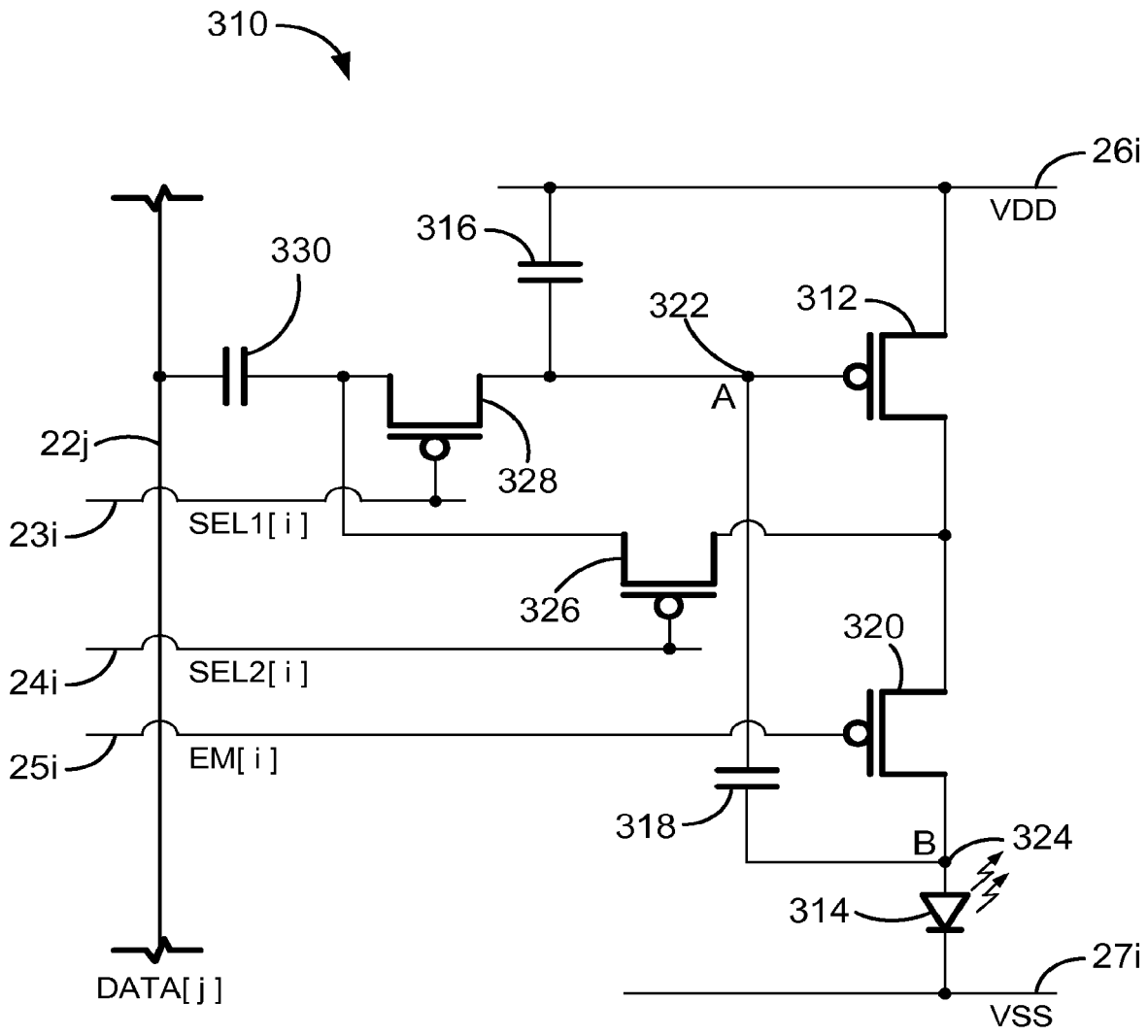
FIG. 4A is a circuit diagram with another exemplary switching circuitry arrangement for the pixel circuit represented in FIG. 2.

FIG. 4A is a circuit diagram for a pixel circuit 310 with another exemplary switching circuitry arrangement for the pixel circuit represented in FIG. 2. Similar to the discussion of the pixel circuit 210 in FIGS. 3A-3B above, the data line 22*j* is also driven with a ramp voltage to generate a current through the pixel circuit 310 via a programming capacitor 330. The pixel circuit 310 also includes an emission control transistor 320 operated according to the emission control line 25*i*, and a light emitting device 314, such as an organic light emitting diode or another current-driven emissive device. The drive transistor 312, emission control transistor 320, and the light emitting device 314 are connected in series such that while the emission control transistor 320 is turned on, current conveyed through the drive transistor 312 is also conveyed through the light emitting device 314. The pixel circuit 310 also includes a storage capacitor 316 having a first terminal connected to a gate terminal of the drive transistor 312 at node A 322. A second terminal of the storage capacitor 316 is connected to the $V_{DD}$ supply line 26*i*, or to another suitable voltage (e.g., a reference voltage) to allow the storage capacitor 316 to be charged according to programming information. The programming capacitor 330 is connected in series between the data line 22*j* and the first switch transistor 328. Thus, the first switch transistor 326 is connected between a first terminal of the programming capacitor 330 and node A 322, while a second terminal of the programming capacitor 330 is connected to the data line 22*j*.

The second switch transistor 326 is connected between a point between the programming capacitor 330 and the first selection transistor 326 and a point between the drive transistor 312 and the emission control transistor 320. Thus, the second selection transistor 326 is connected to the gate terminal of the drive transistor 312 through the first selection transistor 328. In this configuration, the gate terminal of the drive transistor 312 is separated from the emission control transistor 320 by two transistors in series (i.e., the first and second selection transistor 328, 326). Separating the storage capacitor 316 at node A 322 from the path of the driving current by two transistors in series reduces leakage currents through the drive transistor 312 by preventing the source/drain terminals of the drive transistor 312 from influencing the voltage node A 322.

Figure 4B:
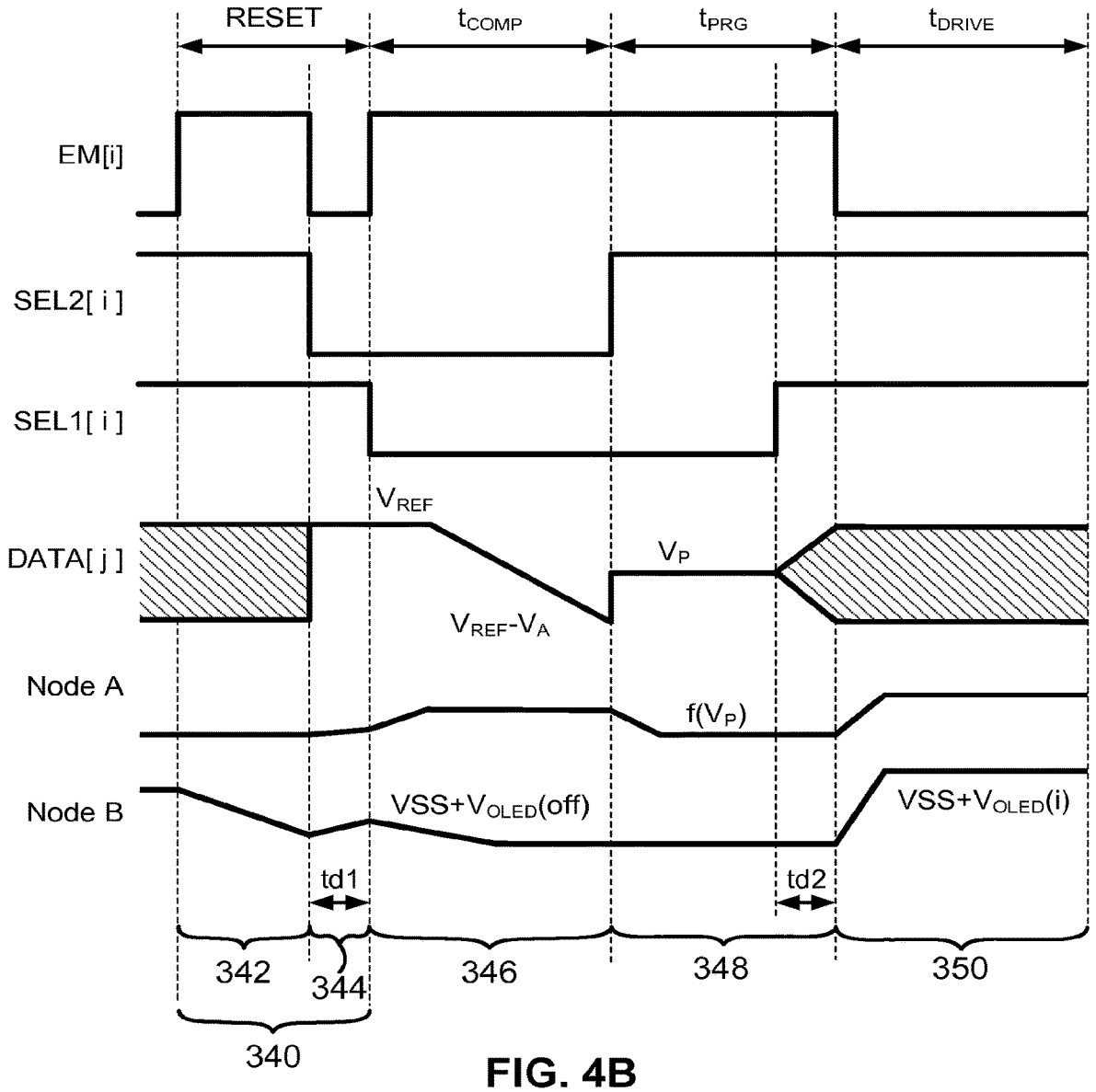
FIG. 4B is a timing diagram illustrating a programming and emission operation of the pixel circuit shown in FIG. 4A where the feedback capacitor automatically accounts for shifts in the operating voltage of the OLED.

FIG. 4B is a timing diagram illustrating exemplary reset, compensation, programming, and emission operations of the pixel circuit 310 shown in FIG. 4A where the feedback capacitor 318 automatically accounts for shifts in the operating voltage of the OLED 314. Operation of the pixel circuit 310 includes a reset cycle 340, a compensation cycle 346, a program cycle 348, and an emission cycle 350 (alternately referred to herein as a driving cycle). The reset cycle 340 includes a first phase 342 and a second phase 344. During the first phase 342, the emission control line EM[i] is set high to turn off the emission control transistor 320 and cease emission from the pixel circuit 310. Once the emission control transistor 320 is turned off, the driving current stops flowing through the light emitting device 314 and the voltage across the light emitting device 314 goes to the OLED off voltage, i.e., $V_{SS}+V_{OLED}$(off). While the emission control transistor 320 is turned off, current stops flowing through the drive transistor 312, and the stress on the drive transistor 312 during the first phase 342 is reduced.

The light emitting device 314 can be an organic light emitting diode with a cathode connected to the $V_{SS}$ supply line 27*i* and an anode connected to the emission control transistor 320 at node B 324. At the end of the first phase 342, the voltage at node B 324 settles at $V_{SS}+V_{OLED}$(off). During the second phase 344, the emission control line 25*i* is set low while the second select line 24*i* is also low and the data line 22*j* is set to a reference voltage $V_{REF}$. Thus, the second selection transistor 326 and the emission control transistor 320 are turned on to connect the programming capacitor 330 between the data line 22*j* charged to $V_{REF}$ and node B 324 charged to $V_{SS}+V_{OLED}$(off). The first selection transistor 328 is held off by the first select line 23*i* during the second phase 344 such that the gate of the drive transistor 312 is not influenced during the reset cycle 340.

The capacitance of the light emitting device 314 ("$C_{OLED}$") is generally greater than the capacitance of the programming capacitor 330 ("Cprg") such that connecting Cprg to $C_{OLED}$ during the second phase 344 (via the emission control transistor 320 and the second selection transistor 326) allows the voltage on Cprg 330 to substantially discharge to $C_{OLED}$. The OLED capacitance acts as a current source/sink to discharge the voltage on Cprg 330 and thereby reset the programming capacitor 330 prior to initiating the compensation and programming operations. During the second phase 344, Cprg 330 and $C_{OLED}$ are connected in series and the voltage difference between $V_{SS}$ and $V_{REF}$ is allocated between them according to a voltage division relationship, with the bulk of the voltage drop being applied across the lesser of the two capacitances (i.e., across Cprg 330). The voltage across Cprg is close to $V_{REF}+V_{OLED}-V_{SS}$ considering $C_{OLED}$ is larger than Cprg. Because the OLED 314 is turned off during the first phase 342, and the voltage at node B 324 is allowed to settle at $V_{SS}+V_{OLED}$ (off), the voltage changes on node B 324 during the second phase 344 are insufficient to turn on the OLED 314, such that no incidental emission occurs.

Following the reset cycle 340, the first and second select lines 23*i*, 24*i* and emission control line 25*i* are operated to provide the compensation cycle 346, the programming cycle 348, and the driving cycle 350, which are each similar to the compensation, programming, and driving cycles 244, 246, 250 discussed at length in connection with FIGS. 3A-3B.

Figure 5A:
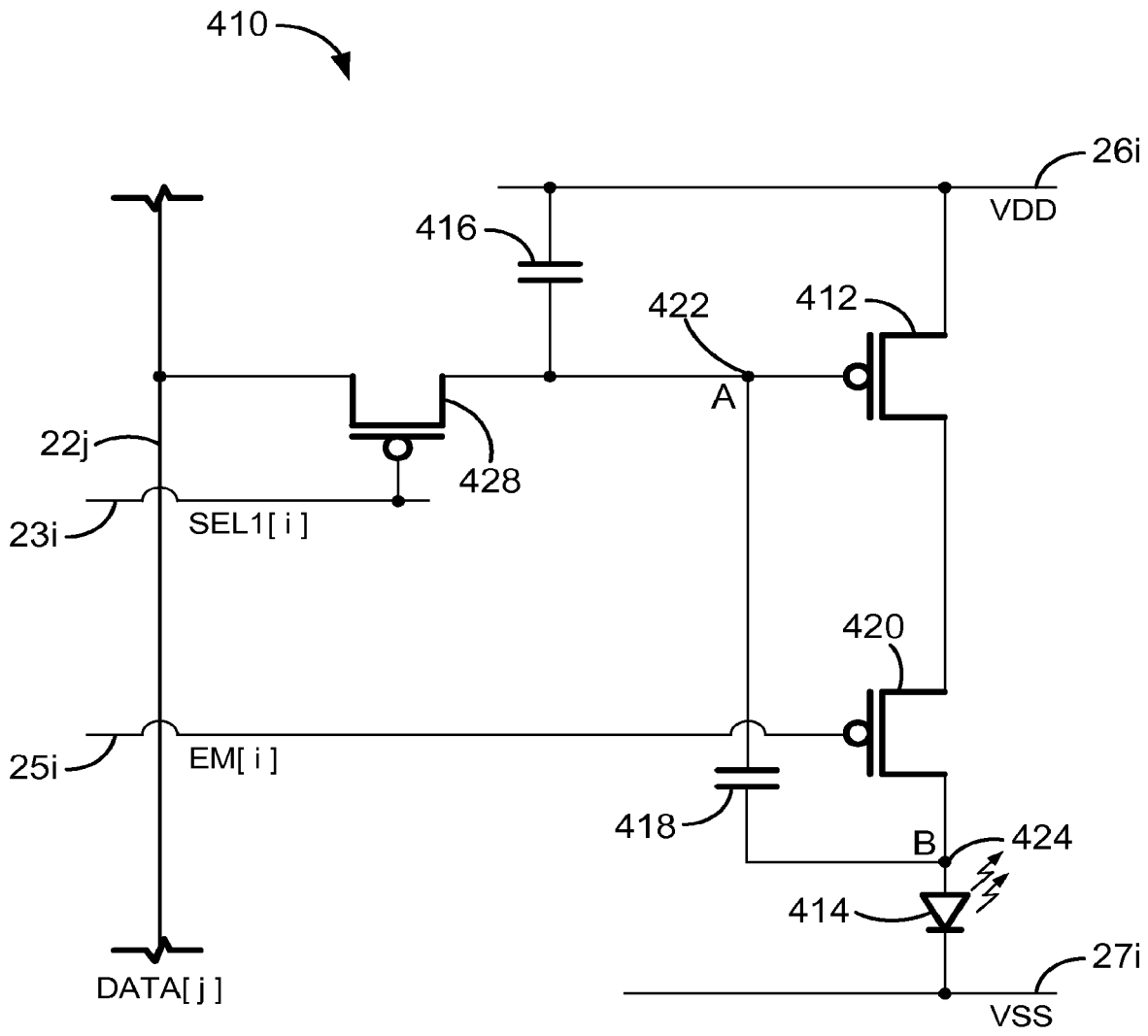
FIG. 5A is a circuit diagram with another exemplary switching circuitry arrangement for the pixel circuit represented in FIG. 2.

FIG. 5A is a circuit diagram of a pixel circuit 410 with another exemplary switching circuitry arrangement for the pixel circuit represented in FIG. 2. The pixel circuit 410 includes a drive transistor 412 connected in series with a light emitting device 414 and an emission control transistor 420 connected between the drive transistor 412 and the light emitting device 414 such that current from the drive transistor 412 is conveyed to the light emitting device 414 only while the emission control transistor 420 is turned on. A switch transistor 428 operated by the first select line 23*i* ("SEL[i]") selectively connects the gate terminal of the drive transistor 412 (at node A 422) to the data line 22*j*.

Figure 5B:
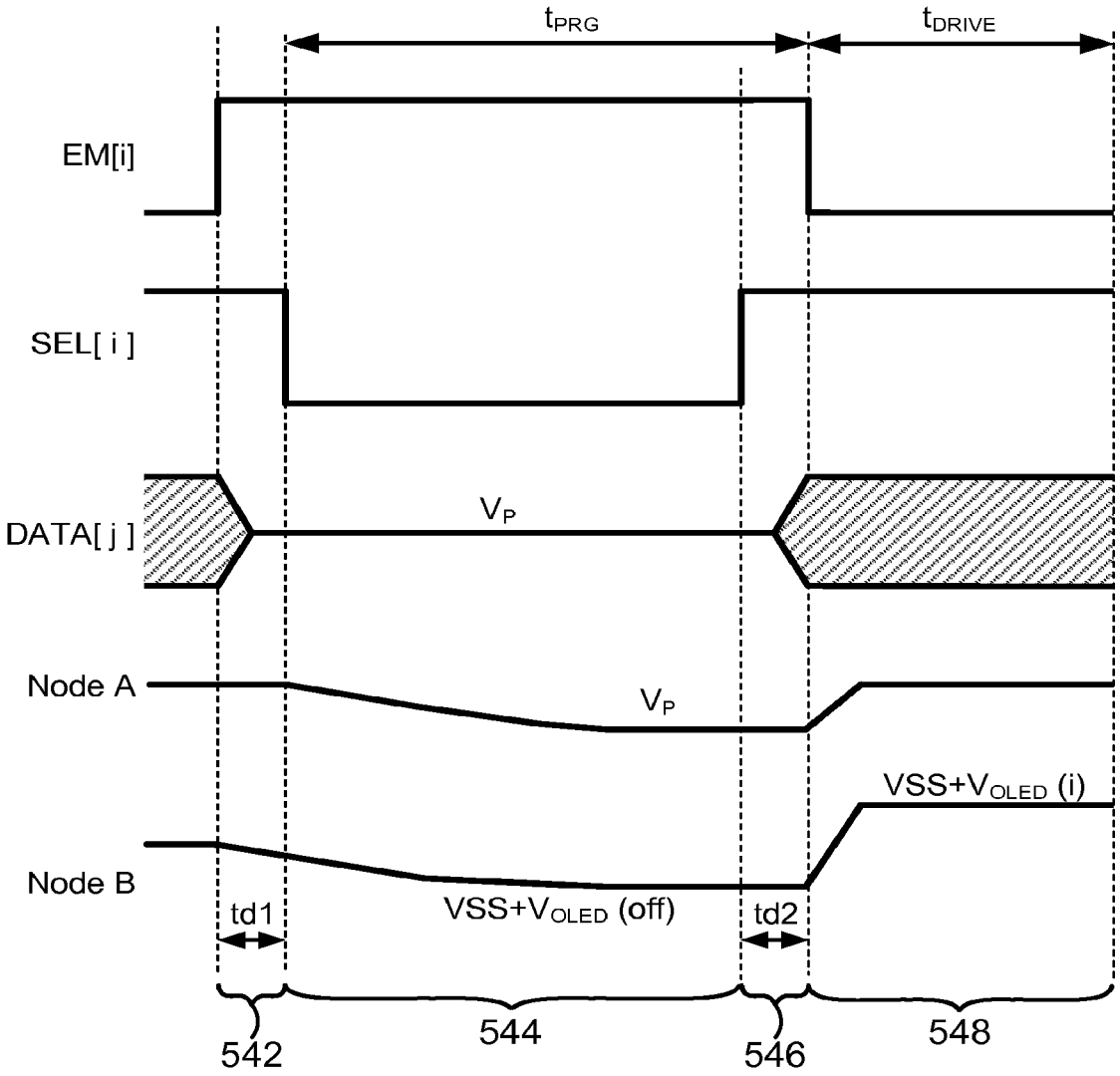
FIG. 5B is a timing diagram illustrating a programming and emission operation of the pixel circuit shown in FIG. 5A where the feedback capacitor automatically accounts for shifts in the operating voltage of the OLED.

FIG. 5B is a timing diagram illustrating a programming and emission operation of the pixel circuit shown in FIG. 5A where the feedback capacitor automatically accounts for shifts in the operating voltage of the OLED. A programming cycle 444 has duration $t_{PRG}$ and an emission cycle 448 has duration $t_{DRIVE}$. A delay period 442 with duration td1 occurs prior to commencing the programming cycle 444. The delay period 442 separates the programming of the pixel circuit 410 from previous values on the data line 22*j* (such as during programming of other rows in the display panel 20 of the display system 50). During the programming cycle 444, the first select line 23*i* ("SEL[i]") is set low to turn on the switch transistor 428 and thereby connect the data line 22*j* to the gate of the drive transistor 412 at node A 422. The storage capacitor 416 is then charged with a programming voltage $V_P$ that is based, at least in part, on programming information for a desired amount of luminance to be emitted from the pixel circuit 410. The emission control 25*i* is set high during the programming cycle to keep the emission control transistor 420 turned off. Turning the emission control transistor 420 off prevents the light emitting device 414 from receiving a drive current from the drive transistor 414 while the pixel circuit is being programmed. Turning the emission control transistor 420 off also allows the voltage across the light emitting device 414 to discharge ("settle") at the voltage $V_{OLED}$(off), which sets the voltage at node B 424 to $V_{SS}+V_{OLED}$(off).

Figure 6A:
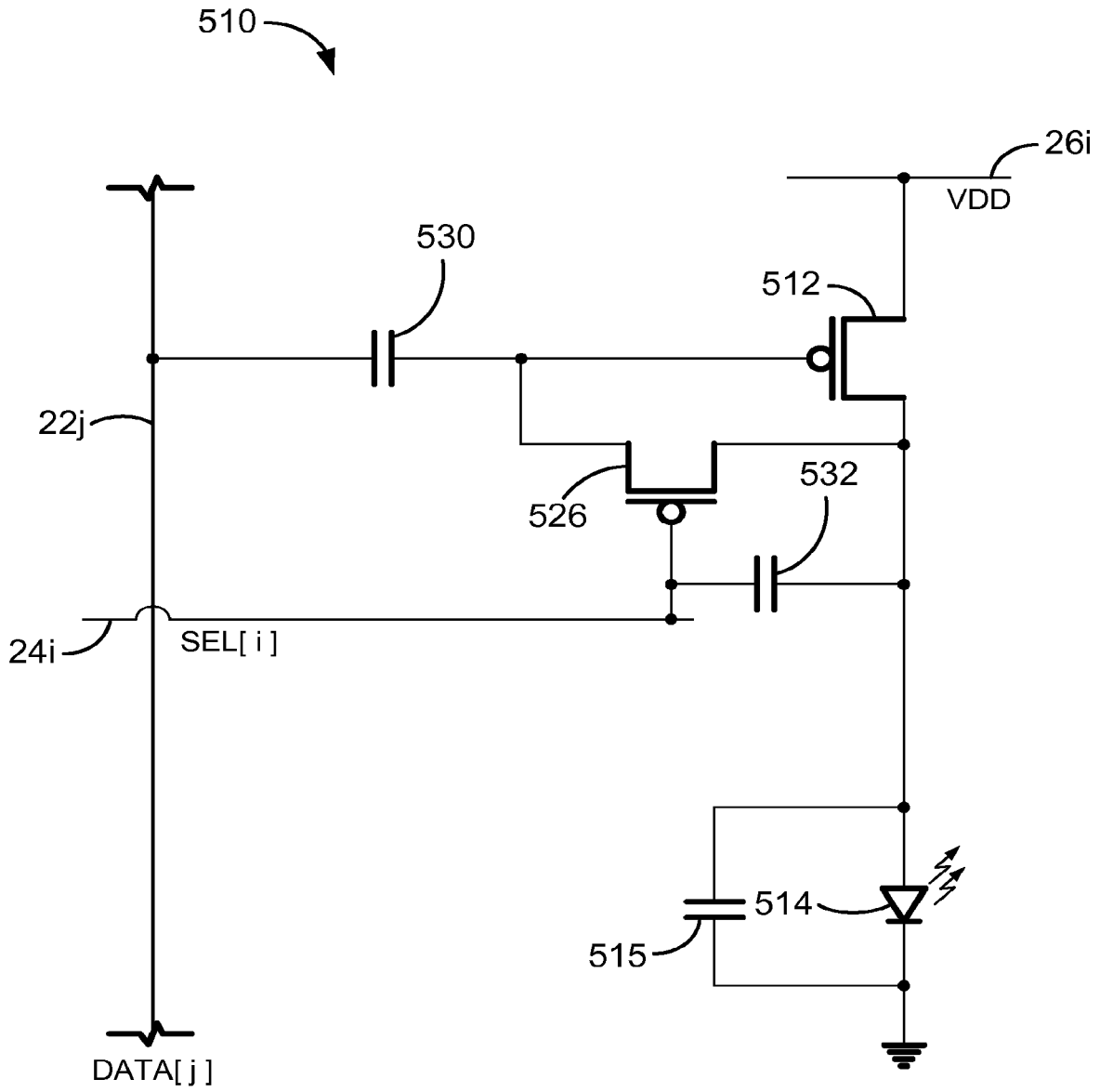
FIG. 6A is a circuit diagram for a pixel circuit including a reset capacitor arranged to reset the drive transistor via an addressing select line.

FIG. 6A is a circuit diagram for a pixel circuit 510 including a reset capacitor 532 arranged to reset the drive transistor 512 via capacitive coupling with the addressing select line 24*i*. The pixel circuit 510 includes a drive transistor 512 connected in series with a current-driven light emitting device 514, which can be an OLED. The capacitance of the light emitting device 514 is represented by the capacitor 415 ("$C_{OLED}$") connected in parallel with the light emitting device 514. A storage capacitor 530 is connected between the gate terminal of the drive transistor 512 and the data line 22*j* ("DATA[j]"). A switch transistor 526 is operated according to the select line 24*i* and connected between the gate terminal of the drive transistor 512 and a point between the drive transistor 512 and the light emitting device 514. The switch transistor 526 is connected to a terminal of the drive transistor 512 opposite the one connected to the $V_{DD}$ supply line 26*i*. For example, the switch transistor 526 can be connected to the drain of the drive transistor 512 and the source of the drive transistor 512 can be connected to the $V_{DD}$ supply line 26*i*. When the switch transistor 526 is turned on, the gate terminal of the drive transistor 512 can be adjusted via the switch transistor 526 according to current flowing through the drive transistor 512

A reset capacitor 532 is situated between the select line 24*i* and a terminal of the switch transistor 526 opposite the one connected the gate of the drive transistor 512. For example, the reset capacitor 532 can be connected to the same terminal of the switch transistor 526 connected to the drain terminal of the drive transistor 512. In this arrangement, the gate terminal of the drive transistor 512 is capacitively coupled to the address select line 24*i* via the reset capacitor 532 while the switch transistor 526 is turned on. The capacitive coupling between the gate terminal of the drive transistor 512 and the select line 24*i* can be used to reset the drive transistor in between programming cycles of the pixel circuit 510, as will be described in connection with the timing diagram in FIG. 6B.

Figure 6B:
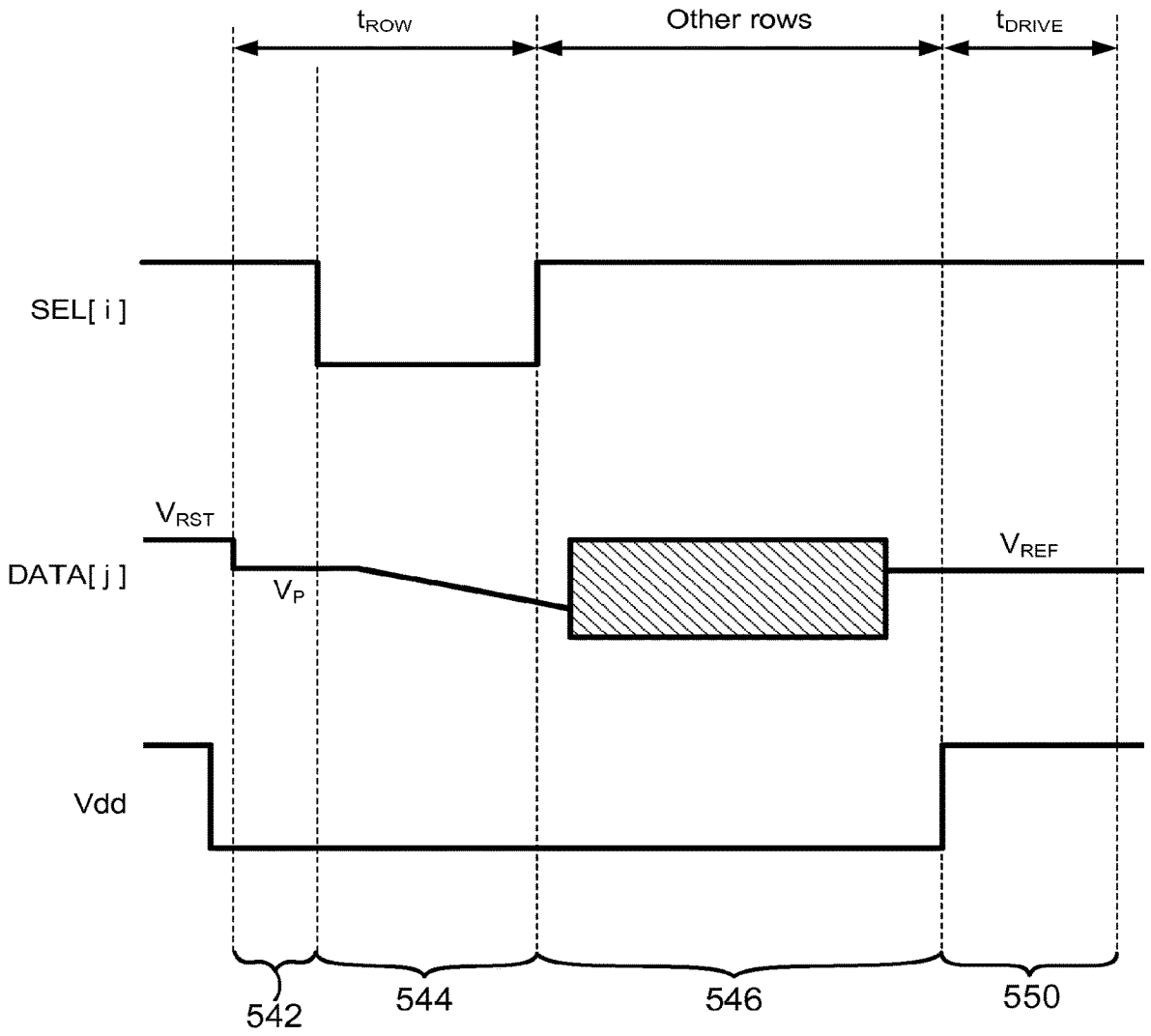
FIG. 6B is a timing diagram for a programming and driving operation of the pixel circuit shown in FIG. 6A.

FIG. 6B is a timing diagram for a programming and driving operation of the pixel circuit 510 shown in FIG. 6A. Prior to a programming cycle the data line 22*j* is set to a reset voltage $V_{RST}$ and the light emitting device 514 is turned off by setting the $V_{DD}$ supply line 26*i* to a low voltage. The low voltage of the $V_{DD}$ supply line 26*i* can be lower than the turn off voltage of the light emitting device 514 (e.g., less than $V_{OLED}$(off)). In some instances, adjusting the $V_{DD}$ supply line 26*i* to the low voltage turns off the OLED 514 and causes the anode of the OLED 514 to settle at $V_{OLED}$(off). The $V_{DD}$ supply line 26*i* can remain at the low voltage level while the data line 22*j* is employed for programming and/or compensation operations to prevent the OLED 514 from emitting incidental light during the programming and/or compensation operations, and thereby increases the contrast ratio of the display.

A programming cycle 542 is initiated by setting the data line 22*j* to a programming voltage $V_P$. The programming voltage $V_P$ is a value determined according to programming information corresponding to a desired amount of luminance to be emitted from the pixel circuit 510. In some embodiments, the programming voltage can optionally be set according to device characteristics of the pixel circuit 510 and/or usage history of the pixel circuit 510 to optionally account for aging degradation in the pixel circuit 510. The data line 22*j* settles at the programming voltage $V_P$ during the programming cycle 542 while the switch transistor 526 remains turned off. At the end of the programming cycle 542, the internal line capacitance of the data line 22*j* is charged according to the programming voltage $V_P$ and the switch transistor 526 is turned on to start the compensation cycle 544. In some examples, the programming cycle 542 can be considered a pre-charge period to charge the data line 22*j* according the programming voltage $V_P$ such that the data line 22*j* is settled at the programming voltage at the start of the compensation period 544 and the pixel circuit 510 remains unaffected by the line capacitance of the data line 22*j*.

The programming voltage $V_P$ is briefly initially maintained on the data line 22*j* to start the compensation cycle 544. Because the switch transistor 526 is turned on to start the compensation cycle 544, the capacitor 530 is no longer floating and is referenced to the turn off voltage of the OLED 514 (i.e., the voltage $V_{OLED}$(off) maintained on the OLED capacitance $C_{OLED}$ 515).

Simultaneously with turning on the switch transistor 526, which is accomplished by setting the select line 24*i* to low, the change in voltage of the select line 24*i*, from high to low, produces a corresponding change in voltage at the gate terminal of the drive transistor 512 due to the capacitive coupling between the select line 24*i* and the gate terminal of the drive transistor 512. The capacitive coupling is provided by the reset capacitor 532 while the switch transistor 526 is turned on such that a voltage change on the select line 24*i* produces a corresponding voltage change at the gate terminal of the drive transistor 512 according to the ratio ($C_{RST}$/($C_{RST}$+$C_{TOTAL}$), where $C_{RST}$ is the capacitance of the reset capacitor 532 and $C_{TOTAL}$ is the total capacitance at the reset node (i.e., the gate terminal of the drive transistor 512). The value of $C_{TOTAL}$ can be determined according to the capacitance of the capacitor 530, the OLED capacitance 515 ("$C_{OLED}$"), and/or capacitance values associated with overlaps in the terminals of the drive transistor 512. Generally, the decrease in the select line 26*i* to turn on the switch transistor 526 produces a corresponding decrease in voltage at the gate terminal of the drive transistor 512. Decreasing the voltage at the gate terminal of the drive transistor 512 (alternately referred to herein as the reset node) can advantageously clear a voltage maintained on the gate terminal after setting the $V_{DD}$ supply line 26*i* to the low voltage to turn off the drive transistor 512.

Thus, the voltage across the capacitor 530 in the initial portion of the compensation cycle 544 is approximately the difference between the programming voltage $V_P$ and the reset voltage ("$V_{RESET}$") at the gate terminal of the drive transistor 512, following the reset operation via the reset capacitor 532. The gate terminal of the drive transistor 512 is alternately referred to herein as the reset node of the pixel circuit 510. The value of $V_{RESET}$ is determined according to the capacitance of the reset node, the voltage change on the select line 24*i*, and the capacitance of the reset capacitor 532, as described below in connection with Equation 3. Some embodiments provide for a pixel circuit that simultaneously turns on a switch transistor to initiate programming and resets the drive transistor via capacitive coupling with the select line that turns on the switch transistor.

The operation of the reset capacitor 532 to reset the voltage at the reset node can alternately be explained in terms of the current paths through the pixel circuit 510. The reset capacitor 532 responds to time-changing voltage on one of its terminals by draining or sourcing current to or from its opposing terminal such that the voltage across the reset capacitor 532 is approximately maintained. When the select line 24*i* changes from a high voltage to a low voltage to initiate the compensation cycle 544 and turn on the switch transistor 526, the reset capacitor 532 draws current toward its opposing terminal. The current is substantially drawn from the reset node, because the anode of the light emitting device 514 is already discharged to $V_{OLED}$(off) and the drive transistor 512 is turned off. The reset capacitor 532 is connected to the reset node through the switch transistor 526 (once the switch transistor 526 is turned on). Accordingly, the reset capacitor 532 and or the switch transistor 526 can be selected to operate such that the turn on time of the switch transistor 526 is comparable to the characteristic charging time of the reset capacitor 532 and thereby prevent the reset capacitor 532 from providing the reset function before the switch transistor 526 is turned on. In some examples, the turn on time of the switch transistor 526 can be less than a characteristic charging time of the reset capacitor 532.

Following the brief initial phase of the compensation cycle 544, the voltage on the data line 22*j* is steadily decreased via a ramp voltage generator. The voltage ramp can be a decreasing voltage that changes from the voltage $V_P$ to a voltage $V_P$-$V_A$ during the compensation cycle 544. The ramp voltage on the data line 22*j* can have a substantially constant time derivative such that a stable current is established across the capacitor 530 according to the time changing ramp voltage. The current across the capacitor 530 is conveyed through the drive transistor 512 via the switch transistor 526 such that a voltage is established on the gate terminal of the drive transistor at the conclusion of the compensation cycle 544. The voltage on the gate terminal of the drive transistor is based, at least in part, on the current-voltage characteristics of the drive transistor 512 and the current across the capacitor 530 due to the ramp voltage, as well as the programming voltage $V_P$ and the reset voltage $V_{RESET}$, which charge across the capacitor 530 during the initial phase of the compensation cycle 544 before the ramp voltage is initiated.

For example, the voltage that settles on the gate terminal of the drive transistor 512 while the ramp voltage is applied to the capacitor 530 can be determined in part by device parameters of the drive transistor 512, such as, for example, the gate oxide ($C_{ox}$), mobility (μ), aspect ratio (W/L), threshold voltage ($V_{th}$), etc. similar to the discussion included above in connection with Equation 2.

The compensation period 544 is followed by programming and compensating other rows in the display panel (during the period 546). While other rows are programmed and/or compensated via the data line 22*j*, the $V_{DD}$ supply line 26*i* is held at the low voltage to prevent incidental emission from the OLED 514. While the other rows are programmed and/or compensated during the period 546, the select line 24*i* is held high to allow the capacitor 530 to float with respect to the data line 22*j* and substantially retain the charge developed during the compensation cycle 544. Once all rows are programmed, the data line 22*j* is changed to a reference voltage $V_{REF}$ and the $V_{DD}$ supply line 26*i* is increased back to its operating voltage (e.g., the voltage value $V_{DD}$) to turn on the drive transistor 512 and initiate the emission cycle 550.

Setting the data line 22*j* at $V_{REF}$ references the capacitor 530 to the reference voltage (as well as the other pixels connected to the data line 22*j*). Accordingly, the voltage applied to the gate terminal of the drive transistor 512 during the emission cycle 550 is determined by the difference between the reference voltage $V_{REF}$ and the voltage across the capacitor 530 at the conclusion of the compensation cycle 546. In some examples, $V_{REF}$ can be approximately the same as the voltage of the $V_{DD}$ supply line during the drive cycle 550 (i.e., the voltage $V_{DD}$). During the emission cycle 550, the drive transistor 512 conveys current to the light emitting device 514 according to the voltage applied to the gate terminal of the drive transistor 512. The light emitting device 514 thus emits light according to the voltage programming information. Furthermore, the light emitting device 514 is driven so as to automatically account for aging degradation in the pixel circuit 510 via the voltage adjustments during the compensation cycle 544.

Figure 7A:
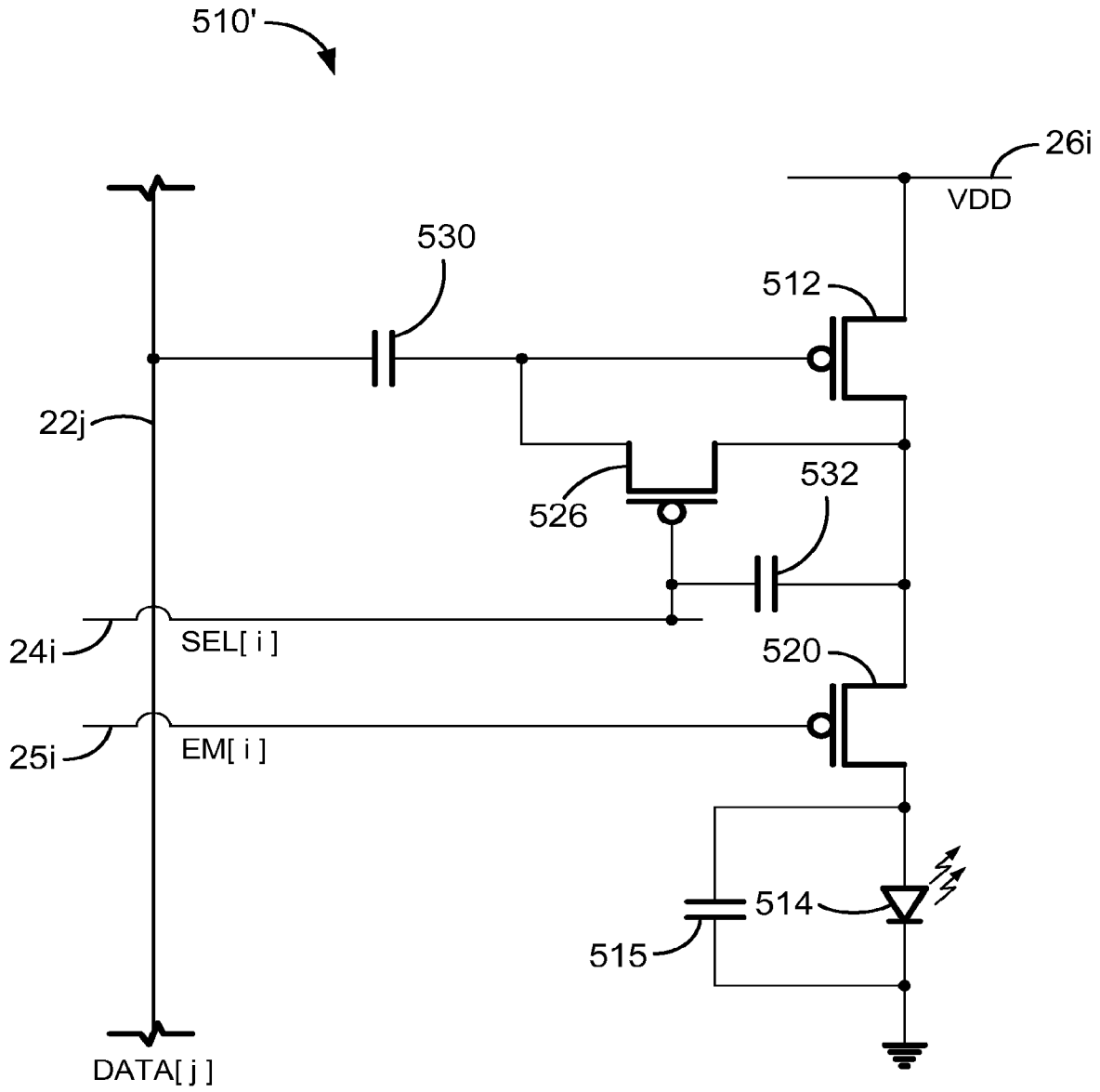
FIG. 7A is a circuit diagram for a pixel circuit similar to the pixel circuit shown in FIG. 6A and also including an emission control transistor to prevent emission during programming
Figure 7B:
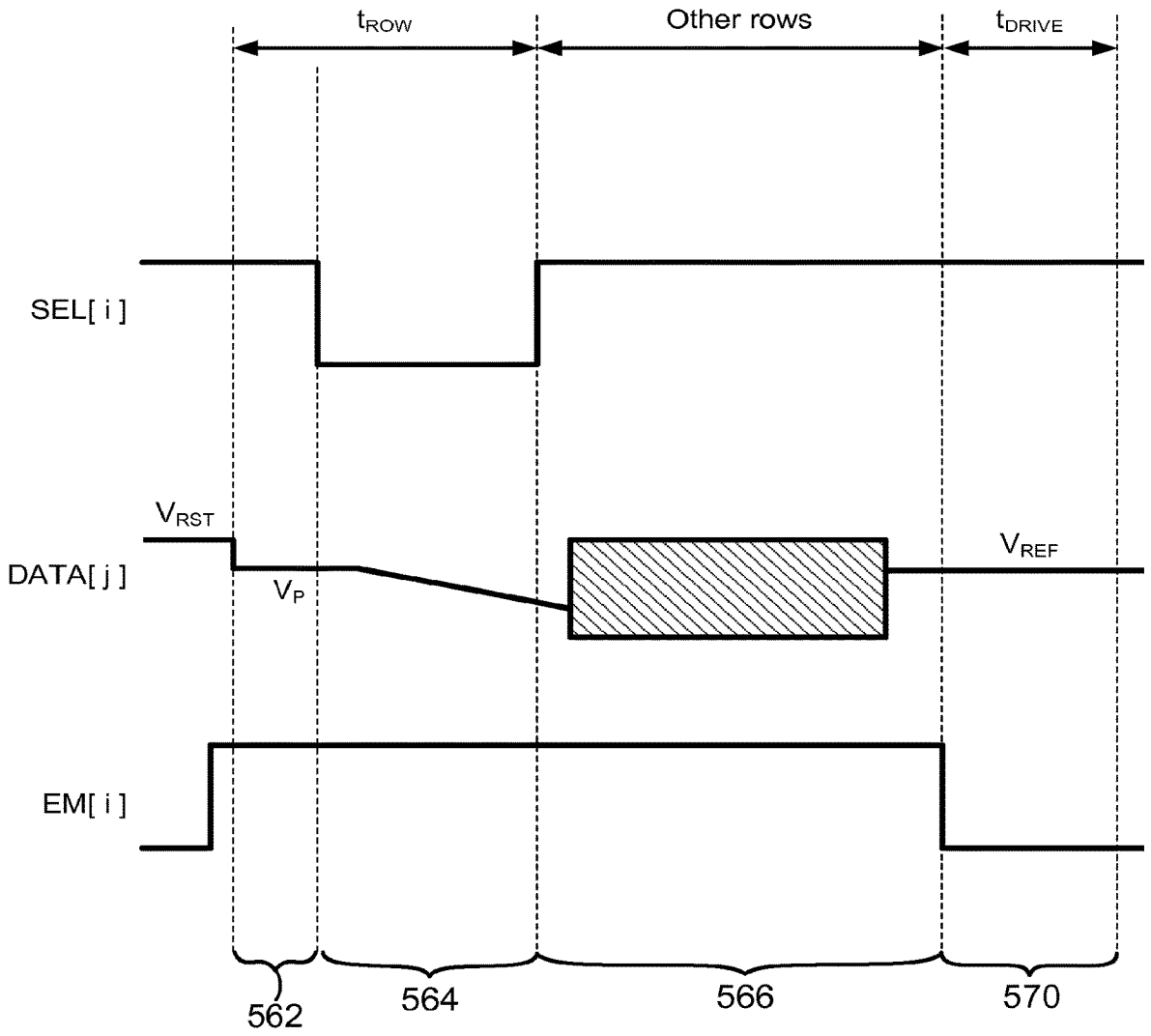
FIG. 7B is a timing diagram for a programming and driving operation of the pixel circuit shown in FIG. 7A.

FIG. 7A is a circuit diagram for a pixel circuit 510' similar to the pixel circuit 510 shown in FIG. 6A and also including an emission control transistor 520 to prevent emission during programming and/or compensation. FIG. 7B is a timing diagram for a programming and driving operation of the pixel circuit 510' shown in FIG. 7A. The emission control transistor 520 is connected in series between the drive transistor 512 and the light emitting device 514 such that current from the drive transistor 512 is only delivered to the light emitting device 514 while the emission control transistor 520 is turned on. The emission control transistor 520 is controlled by the emission control line 25*i* to be turned off while the emission control line 25*i* is set high during the programming cycle 562 and the compensation cycle 564. The emission control transistor 520 thus provides a function similar to the adjustable voltage supply line 26*i* in FIG. 6A, to prevent emission from the light emitting device while the data line 22*j* is employed for compensation and programming of the pixel circuit 510' during the periods 562, 564, and for compensation and programming of the other rows in the display array during the period 566.

During the programming cycle 562 ("pre-charge cycle") the data line 22*j* is set to the programming voltage $V_P$, the emission line 25*i* is set high to turn off the emission control transistor 520, and the select line 24*i* is set high to turn off the switch transistor 526. At the conclusion of the programming cycle 562, the data line 22*j* settles at the programming voltage V. During the compensation cycle 564, the select line 24*i* is set low to turn on the switch transistor 526, which capacitively couples the select line 24*i* and the gate terminal of the drive transistor 512, through the reset capacitor 532. The emission control line 25*i* remains high and so the emission control transistor 520 and the series-connected light emitting device 514 are both off during the compensation cycle 564.

The decrease in voltage on the select line 24*i* to turn on the switch transistor 526 to initiate the compensation cycle 564 generates a corresponding decrease in voltage at the gate terminal of the drive transistor 512, due to the capacitive coupling provided by the reset capacitor 532. In FIGS. 7A-7B, the reset operation is carried out while the light emitting device 514 is turned off by the emission control transistor 520, rather than by setting the $V_{DD}$ supply line 26*i* to a low voltage.

Display arrays including either of the pixel circuits 510, 510' described in connection with FIGS. 6A-7B can generally be driven to first program (and compensate) the entire display, and then drive the display to emit light according to the programming. Because the capacitors in each pixel (e.g., the capacitor 530) are directly connected to the data line 22*j* shared by a plurality of pixel circuits, programming and compensation must be completed entirely while the display is turned off. The display can be turned off via the adjustable voltage supply line (FIG. 6B) or via the emission control transistor (FIG. 7A). Once the programming and compensation of the entire display panel is complete, the data line 22*j* is set to the reference voltage $V_{REF}$ to drive the display in the emission cycle 550, 570. Because the data line 22*j* is set to the reference voltage $V_{REF}$ during the emission cycle, the data line 22*j* is not available for programming or compensation. As a result, some displays are driven to appear entirely dark during programming and then appear entirely bright during driving. In some examples, a display panel can be divided into groups of segments that each share a common data line, and each segment can be programmed and/or compensated row-by-row, within the segment, and then driven while other segments sharing distinct data lines are programmed and/or compensated.

Figure 8A:
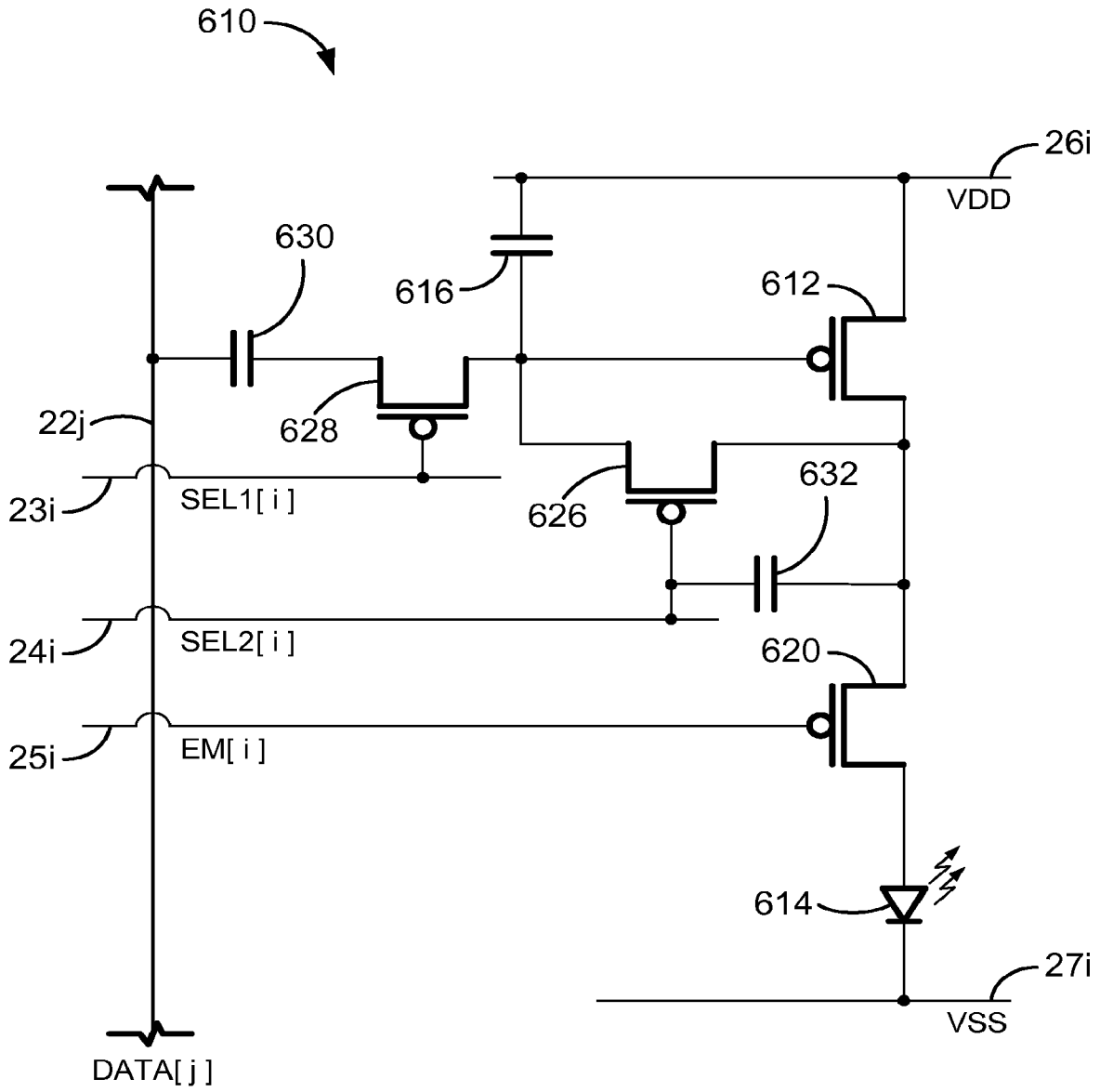
FIG. 8A is a circuit diagram for another pixel circuit including a reset capacitor arranged to reset the driving transistor via an addressing select line and also including a programming capacitor connected to a gate terminal of the drive transistor via a first selection transistor.

FIG. 8A is a circuit diagram for another pixel circuit 610 including a reset capacitor 632 arranged to reset the driving transistor 612 via an addressing select line 24*i* and also including a programming capacitor 630 connected to a gate terminal of the drive transistor 612 via a first selection transistor 628. The pixel circuit 610 can be employed as the pixel 10 in the display panel 20 of the system 50 shown in FIG. 1. The pixel circuit 610 includes a storage capacitor 616 that is arranged to influence the conductance of the drive transistor 612 by applying a voltage charged on the storage capacitor 612 to the gate terminal of the drive transistor 612. The storage capacitor 616 is connected between the gate terminal of the drive transistor 616 and the VDD supply line 26*i*, but can also be connected to another stable voltage sufficient to allow the storage capacitor 616 to be charged according to programming information and apply the charge to the drive transistor 612 during an emission cycle. The drive transistor 612 is connected in series with the emission control transistor 620 and the light emitting device 614 such that the light emitting device 614 is operated according to current conveyed through the drive transistor 612.

The first switch transistor 628 is operated according to the first select line 23*i* and selectively connects the gate terminal of the drive transistor 612 to the programming transistor 630 to convey programming and compensation signals from the data line 22*j* to the pixel circuit 610. For example, the pixel circuit 610 can be programmed and/or compensated via the capacitive coupling with the data line 22*j* provided by the programming capacitor 630 while the first switch transistor is turned on 628. Additionally or alternatively, while the first switch transistor 628 is turned off, the pixel circuit 610 can be operated independently of the data line 22*j* to allow the data line 22*j* to be employed for programming and/or compensation of other pixel circuits connected to the data line 22*j*, such as, for example, pixel circuits in other rows of the display panel 20 of the system 50.

The second switch transistor 626 is operated according to the second select line 24*i* and selectively connects the gate terminal of the drive transistor 612 to a node between the drive transistor 612 and the emission control transistor 620. In some examples, the second switch transistor 626 can provide a current path for the gate of the drive transistor 612 to be adjusted according to current being conveyed through the drive transistor 620. For example, while both switch transistors 626, 628 are turned on a current can flow through the drive transistor 612, the second switch transistor 626, and the first switch transistor 628 and across the programming capacitor 630 and the voltage at the gate terminal of the drive transistor 612 can adjust according to the current. Such a current can be provided by applying a decreasing ramp voltage to the programming capacitor 630 via a ramp voltage generator connected to the data line 22*j*.

The second switch transistor 626 also selectively connects the reset capacitor 632 to the gate terminal of the drive transistor 612. Thus, while the second switch transistor 626 is turned on, the reset capacitor 632 capacitively couples the gate terminal of the drive transistor 612 (i.e., the reset node) to the select line 24*i* such that the reset node can be reset (e.g., adjusted to the reset voltage $V_{RESET}$) by operation of the select line 24*i*. The reset capacitor 632 generally operates similarly to the reset capacitor 532 in FIGS. 6A-7B. In some embodiments, the adjustment of the select line 24*i* from the high voltage ("Voff") to the low voltage ("Von") simultaneously turns on the second switch transistor 626 and resets the voltage at the gate terminal of the drive transistor 612.

The pixel circuit 610 in FIG. 8A is similar in some respects to the pixel circuit 210 in FIG. 3A, except for that the pixel circuit 610 includes the reset capacitor 632 for resetting the drive transistor 612 rather than the feedback capacitor 218 described in connection with FIG. 3A. However, where certain circuit elements in the pixel circuit 610 perform functions similar to those described in connection with the pixel circuit 210, those elements have been identified with element numbers having the same final two digits as the corresponding elements in the pixel circuit 210. For example, the first transistor 628 functions similarly to the first transistor 228; the storage capacitor 616 functions similarly to the storage capacitor 216; the emission control transistor 620 functions similar to the emission control transistor 220, etc.

Figure 8B:
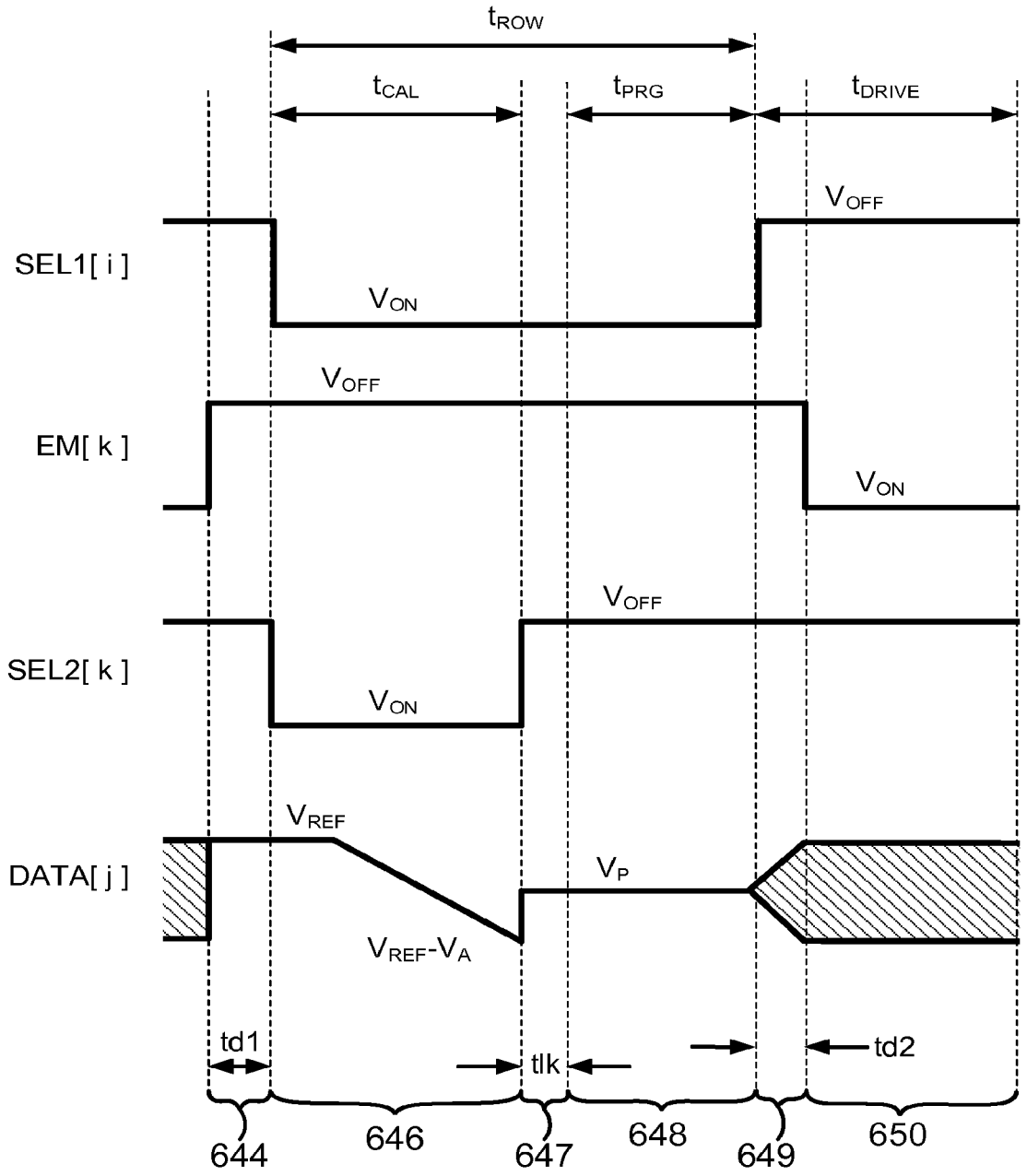
FIG. 8B is a timing diagram for resetting, compensation, programming, and driving operations of the pixel circuit shown in FIG. 8A.

FIG. 8B is a timing diagram for resetting, compensation, programming, and driving operations of the pixel circuit 610 shown in FIG. 8A. The compensation cycle 646 is preceded by a brief delay period 644 to establish the reference voltage $V_{REF}$ on the data line 22*j*. The delay period 644 with duration td1 allows time for the voltage on the data line 22*j* to change from its previous value, such as a programming voltage for another row, to the reference voltage $V_{REF}$. The duration td1 of the delay period 644 can be determined based on the timing budget of the display panel and the line capacitance of the data line 22*j*, which influences the rate at which voltage can be changed on the data line 22*j*. The emission control line 25*i* can optionally be set high during the delay period 644 to turn off the light emitting device 614 and provide a brief temporal separation between turning off the light emitting device 614 and initiating the compensation and/or programming operations by turning on one or both of the switch transistors 626, 628.

Following the delay period 644, the second select line 24*i* is set low to turn on the second switch transistor 626. Turning on the second switch transistor 626 connects the reset capacitor 632 between the gate terminal of the drive transistor 612 and the second select line 24*i*. Thus, once the second switch transistor 626 turns on, the gate terminal of the drive transistor 612 (and the storage capacitor 616) are capacitively coupled to the second select line 24*i* via the reset capacitor 632. As a result, the change in voltage on the second select line 24*i* from Voff to Von to turn on the second switch transistor 626 also produces a corresponding change in voltage on the gate terminal of the drive transistor 612 (and the storage capacitor 616). In some examples, the voltage of the gate terminal of the drive transistor 612 is changed by ΔV, as described in connection with Equation 3. In some examples, the voltage of the gate terminal of the drive transistor 612 is adjusted to a reset voltage $V_{RESET}$, which is described in connection with Equation 3 below.

The compensation cycle 646 follows the delay period 644. Both switch transistors 626, 628 are turned on during the compensation cycle 646 and the emission control transistor 620 is turned off. A ramp voltage is applied on the data line 22*j* during the compensation cycle 646 to convey a current through the pixel circuit, via the programming capacitor 630. The ramp voltage can be applied with a brief interval where the data line 22*j* holds the reference voltage $V_{REF}$ and then decreases to $V_{REF}V_A$ during the remainder of the compensation cycle 646. The value of the current conveyed through the pixel circuit 610 via the programming capacitor 630 is determined, at least in part, by the rate of voltage change on the data line 22*j* while the current ramp is provided. The voltage change can have a substantially constant time derivative such that the resulting current across the programming capacitor 616 is substantially constant. The voltage at the gate node of the drive transistor 612 self-adjusts during the compensation cycle 646 to account for aging degradations in the drive transistor, such as, for example the threshold voltage, mobility, gate oxide, and/or other factors influencing the current-voltage characteristics of the drive transistor 612.

A cross-talk delay period 647 occurs between the compensation cycle 646 and the programming cycle 648. During the cross-talk delay period 647, the data line 22*j* is adjusted from $V_{REF}$-$V_A$ to a programming voltage $V_P$. The second select line 24*i* is set high to begin the cross-talk delay period 647 to isolate the adjustments on the data line 22*j* from the current path through the drive transistor (e.g., the drain terminal of the drive transistor 612) and thereby prevent the drive transistor 612 from self-adjusting its gate voltage during the voltage programming operation, or while the data line 22*j* is adjusted and/or between values.

During the programming cycle 648, the first switch transistor 628 is turned on and the storage capacitor 616 is charged according to the programming voltage $V_P$ on the data line 22*j*. The storage capacitor 616 is capacitively coupled to the data line 22*j* via the first switch transistor 628, and so the programming voltage $V_P$ applied to the data line 22*j* can be determined according to a change in voltage (e.g., relative to the value $V_{REF}$-$V_A$), rather than according to an absolute voltage level. Generally, the programming voltage is selected to be sufficient to charge the storage capacitor 616 to thereby influence the conductance of the drive transistor 612 during the following emission cycle 650. At the conclusion of the programming cycle 648, the first select line 23*i* is set high to turn off the first switch transistor 628 and thereby disconnect the pixel circuit 610 from the data line 22*j*. After a second delay period 649 with duration td2, the emission control transistor 620 is turned on to initiate the emission cycle 650. The second delay period 649 provides temporal separation between disconnection from the data line 22*j* and emission cycle 650 to thereby prevent the pixel circuit 610 from being influenced by signals on the data line 22*j* during the emission cycle 650. During the emission cycle 650, the pixel circuit 610 emits light from the light emitting device 614 according to the charge held on the storage capacitor 616.

Figure 9A:
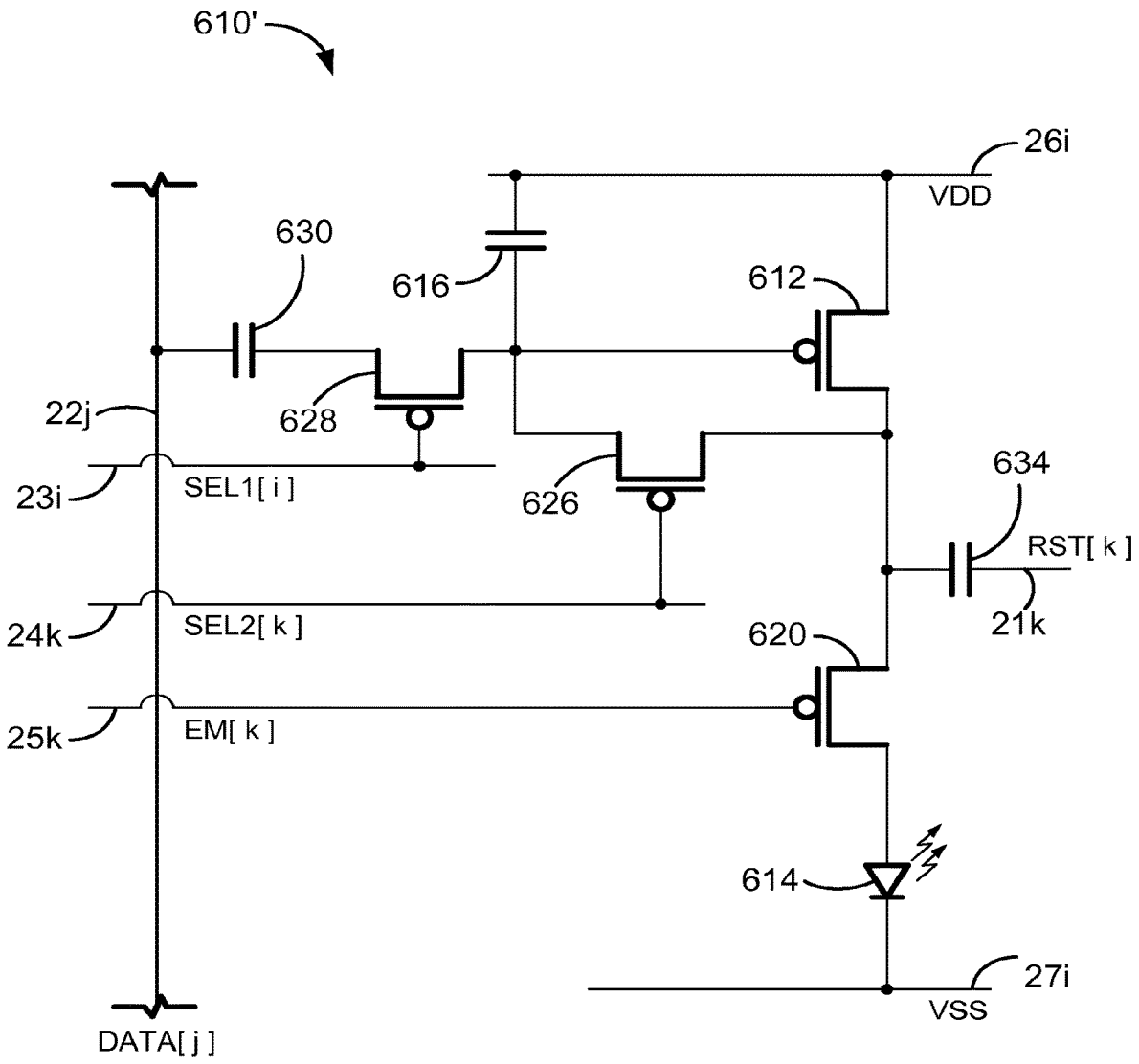
FIG. 9A is a circuit diagram for another pixel circuit similar to the pixel circuit shown in FIG. 8A, but where the reset capacitor is arranged to reset the driving transistor via a reset select line.
Figure 9B:
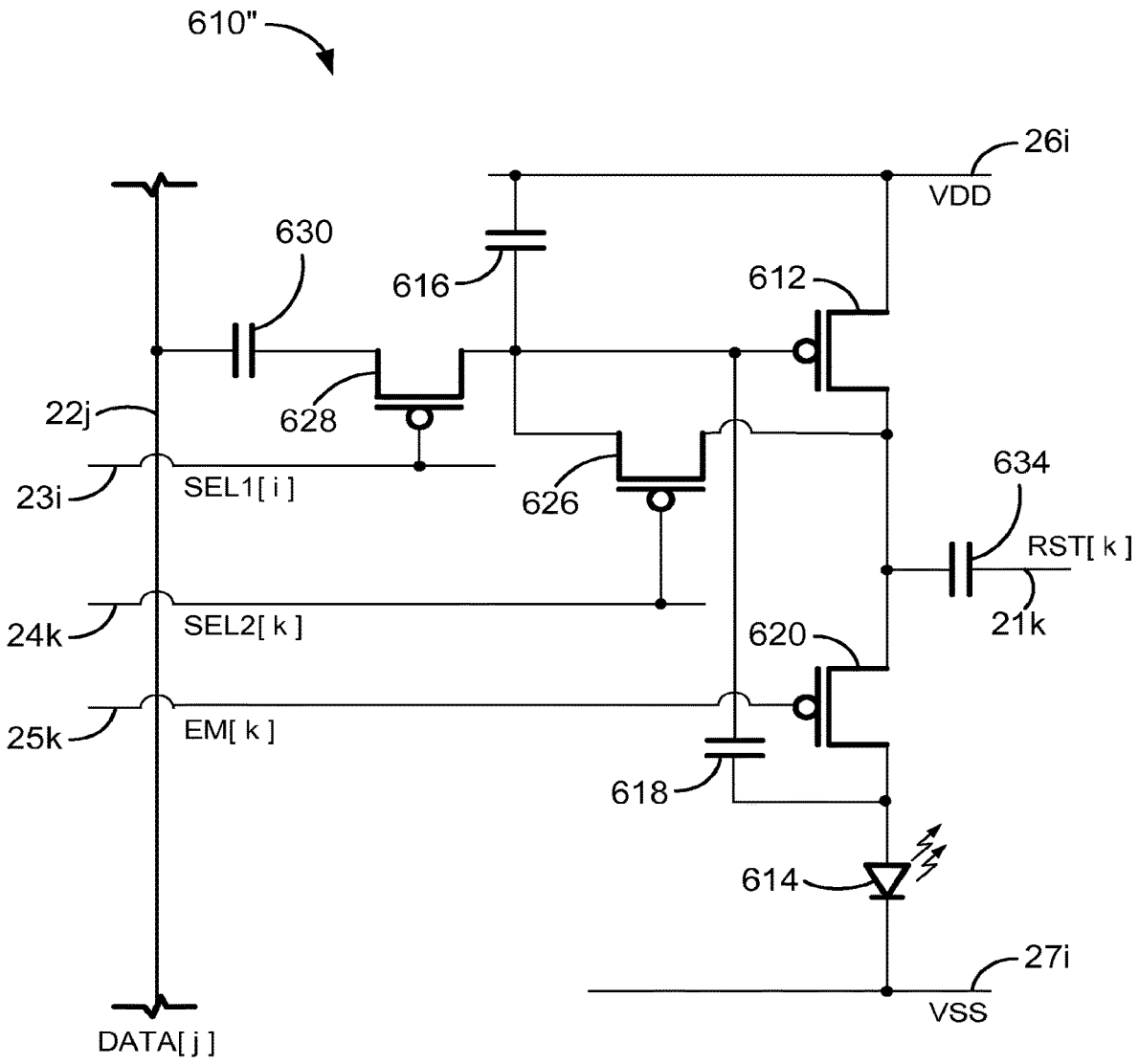
FIG. 9B is a circuit diagram for another pixel circuit similar to the pixel circuit shown in FIG. 9A, but also including a feedback capacitor.
Figure 9C:
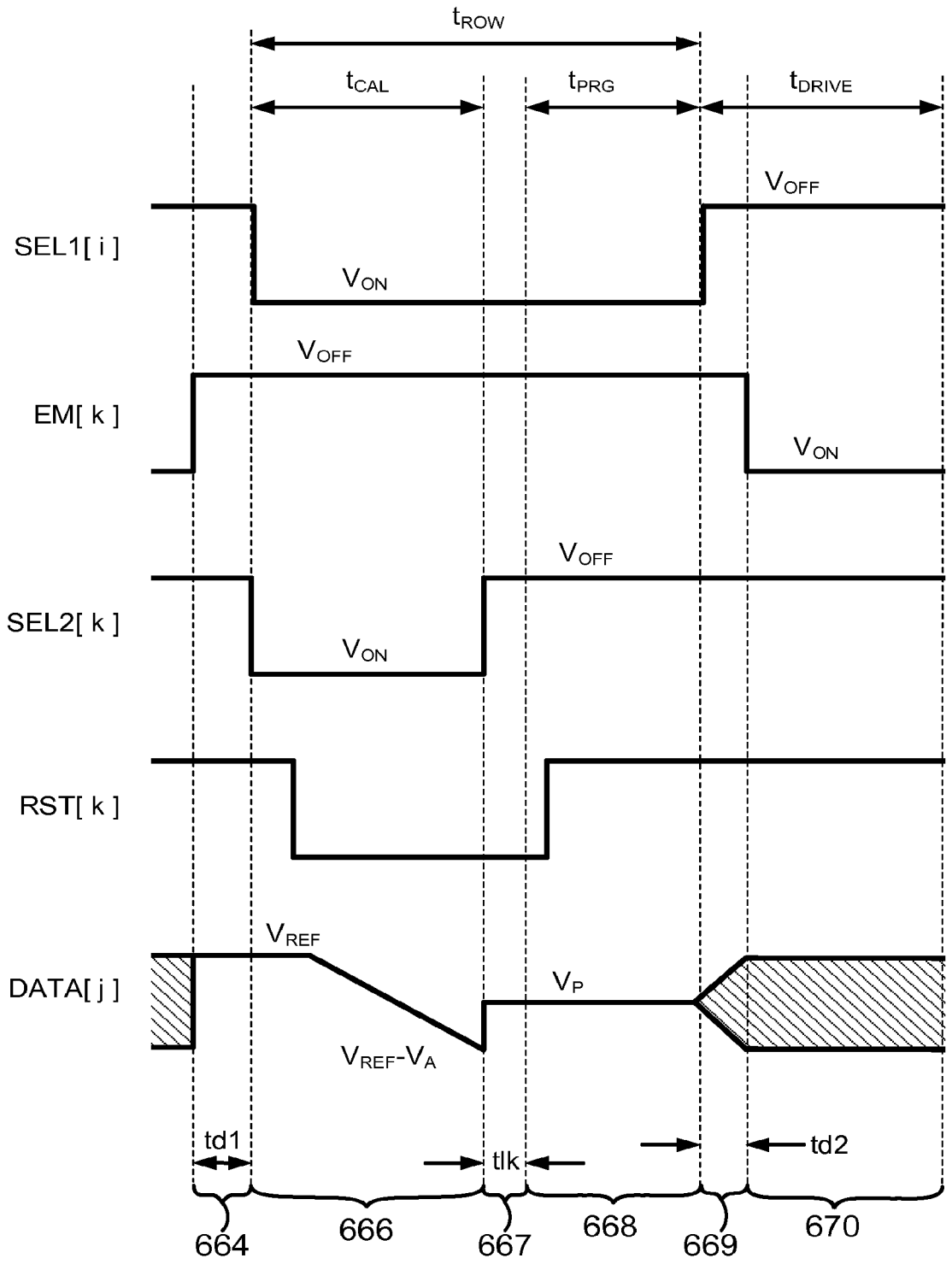
FIG. 9C is a timing diagram for resetting, compensation, programming, and driving operations of the pixel circuits shown in FIGS. 9A and 9B.

FIG. 9A is a circuit diagram for another pixel circuit 610' similar to the pixel circuit 610 shown in FIG. 8A, but where a reset capacitor 634 is arranged to reset the driving transistor 612 via a reset line 21*k*. FIG. 9B is a circuit diagram for another pixel circuit 610" similar to the pixel circuit 610' shown in FIG. 9A, but also including a feedback capacitor 618 to automatically account for instabilities in the pixel current. FIG. 9C is a timing diagram for resetting, compensation, programming, and driving operations of the pixel circuits 610', 610" shown in FIGS. 9A and 9B. The operation and structure of the pixel circuit 610' is similar to the pixel circuit 610 described in connection with FIGS. 8A and 8B, with the exception of the reset capacitor 634. One terminal of the reset capacitor 634 is connected to the reset line 21*k* ("RST"), rather than to the second select line. The other terminal of the reset capacitor 634 is connected to the node between the drive transistor 612 and the emission control transistor 620. As a result, the reset line 21*k* is capacitively coupled to the gate terminal of the drive transistor 612 while the second switch transistor 626 is turned on.

In addition, the second switch transistor 626 and the emission control transistor 620 are operated by segmented control lines shared by the "kth" segment of a segmented display panel. The second switch transistor 626 is operated by a segmented second select line 24*k* ("SEL2[k]") and the emission control transistor 620 is operated by a segmented emission control line 25*k* ("EM[k]"). The reset line 21*k* can also be a segmented line shared by pixels in the "kth" segment of the display panel. The "kth" segment of the display panel can be a segment including more than one row of the display panel and can include adjacent rows or non-adjacent rows. For example, a display panel with 720 rows can be divided into 144 segments with 5 rows in each segment. As shown further in FIG. 10, the pixels in the "kth" segment can also share a common programming capacitor (e.g., the programming capacitor 730) and/or a common reset capacitor (e.g., the reset capacitor 734).

Operating the pixel circuit 610' (or the pixel circuit 610") includes a compensation cycle 666 preceded by a first delay period 664 with duration td1 to set the data line 22*j* to the reference voltage $V_{REF}$. The gate terminal of the drive transistor 612 is self-adjusted during the compensation cycle 666 according to a current across the programming capacitor 630 that is based on the voltage ramp on the data line 22*j*. A cross-talk delay 667 separates the compensation cycle 666 from a programming cycle 668 to allow the data line 22*j* to adjust while the second switch transistor 626 is turned off. The storage capacitor 616 is charged according to programming information during the programming cycle 668. A second delay period 669 with duration td2 separates the programming cycle 668 from an emission cycle 670 while the first switch transistor 628 is turned off to isolate the pixel circuit 610' (or 610") from the data line 22*j* during the emission cycle 670. During the emission cycle 670, the light emitting device 614 emits light according to the programming information.

In the pixel circuit 610" in FIG. 9B, a feedback capacitor 618 is connected between the light emitting device 614 and the gate terminal of the drive transistor 612. The feedback capacitor 618 operates similarly to the feedback capacitor 118 discussed in connection with FIG. 2 to account for variations and/or instabilities in the voltage of the light emitting device 614. During the compensation and programming cycles 666, 668, the voltage at the anode terminal of the light emitting device 614 discharges to $V_{OLED}$(off) while the emission line 25*k* is set high. Then, during the emission cycle 670, the light emitting device 614 is turned on by the drive current provided via the drive transistor 612. The feedback capacitor 618 capacitively couples the gate terminal of the drive transistor 612 to the light emitting device 614 such that changes in the voltage of the light emitting device 614 generate corresponding voltage changes at the gate terminal of the drive transistor 612.

For example, an increased current through the light emitting device 614 (due to, for example, an instability in the drive transistor 612) generates an increased voltage at the gate terminal of the drive transistor 612 due to increased power dissipation in the light emitting device 614. The increased voltage causes a corresponding voltage increase at the gate terminal of the drive transistor 612 according to the capacitive current division relationship across the feedback capacitor, as explained in connection with Equation 1 above. The voltage increase at the gate terminal of the drive transistor 612 decreases the gate-source voltage on the drive transistor 612 and accordingly decreases the current through the light emitting device 614 to correct for the instability in the drive transistor 612 (or for instabilities in the light emitting device 614). Similarly, a voltage decrease at the light emitting device 614 generates an increased current to the light emitting device 614 by the drive transistor 612. Thus, the feedback capacitor 618 automatically accounts for instabilities in the drive transistor 612 and/or light emitting device 614 during the emission cycle 670.

In the pixel circuits 610', 610", the reset capacitor 634 is operated to reset the gate terminal of the drive transistor 612 prior to initiating programming. However, in contrast with the pixel circuit 610 described in connection with FIGS. 8A-8B, the reset capacitor 634 is operated by the reset line 21*k*, which is distinct from the second select line 24*k* that operates the second switch transistor 626. Thus, in the arrangement of the pixel circuit 610' (or 610"), the switch transistor 626 can be turned on prior to initiating the reset operation. As shown in the timing diagram of FIG. 9C, the second switch transistor 626 can be turned on at the start of the compensation cycle 666. Once the second switch transistor 626 is turned on, the gate terminal of the drive transistor 612 is capacitively coupled to the reset line 21*k* via the reset capacitor 634. After a brief delay following turn on of the second switch transistor 626, the reset line 21*k* can be adjusted to a low voltage so as to generate a corresponding voltage adjustment at the gate terminal of the drive transistor 612 (and the storage capacitor 616).

The reset operation (i.e., voltage change on the reset line 21*k*) may be carried out during the initial phase of the compensation cycle 666 while the data line 22*j* is still set at the reference voltage $V_{REF}$, prior to the application of the ramp voltage. The reset operation changes the voltage at the gate terminal of the drive transistor 612 according to the change in voltage on the reset line 21*k* and the voltage division relationship across the reset capacitor 634 and the capacitance at the gate terminal (e.g., due to the storage capacitor 616). The voltage change ΔV generated at the reset node is discussed in connection with Equation 3 below. The reset line 22*k* can be returned to the high voltage following the compensation cycle 666, after the second switch transistor 626 is turned off, and prior to the initiation of the emission cycle 670 so as to prevent the voltage increase on the reset line 22*k* from influencing the programming or emission operations of the pixel circuit 610' (or the pixel circuit 610").

The pixel circuit 610" in FIG. 9B provides one exemplary circuit arrangement including both a reset capacitor (e.g., the reset capacitor 634) and a feedback capacitor (e.g., the feedback capacitor 618). However, the pixel circuit 610" provides one illustrative example of a pixel circuit that combines both the reset capacitor to provide for resetting a data node prior to programming and a feedback capacitor to provide for automatically adjusting a data node during emission. In other examples, any of the circuit arrangements including feedback capacitors in FIGS. 2-5A can be combined with any of the circuit arrangements including reset capacitors, such as shown in FIGS. 6A-9A. In some embodiments of the present disclosure, pixel circuits are provided with one or more capacitors arranged to capacitively couple to a data node of the pixel circuits to regulate the voltage at the data node to receive programming information and/or account for dynamic instabilities in semiconductive elements in the pixel circuits. For example, a feedback capacitor can be included in the pixel circuit 510' of FIG. 7A. In such an example, a feedback capacitor is connected between the anode of the light emitting device 514 and the gate terminal of the drive transistor 512. In another example, a reset capacitor can be included in the pixel circuit 210 of FIG. 3A. In such an example, a reset capacitor is connected between the second select line 24*i* (or a dedicated reset line) and the gate terminal of the drive transistor.

Figure 10:
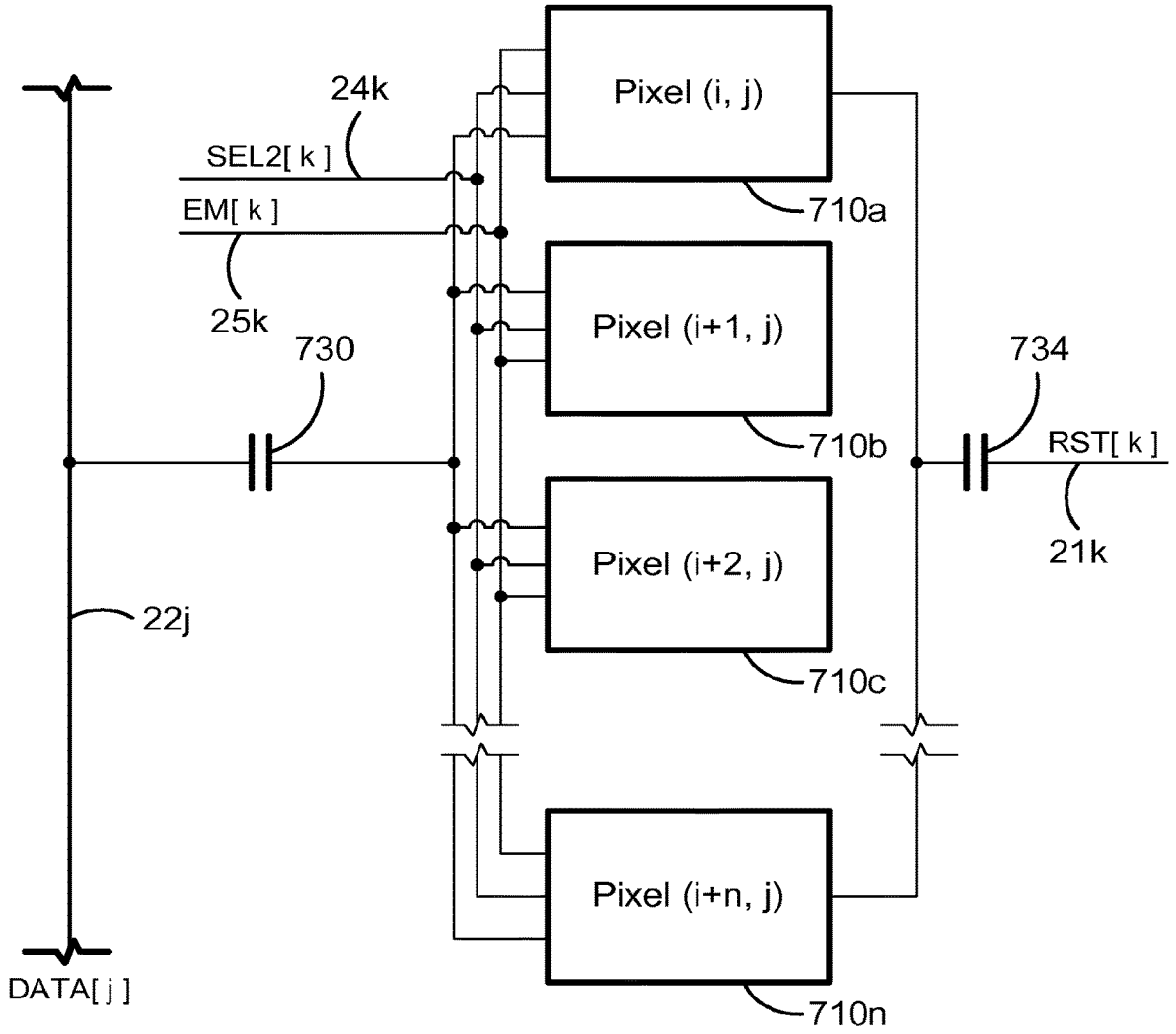
FIG. 10 is a block diagram of a section of a display system arranged to share a common programming capacitor and reset capacitor between multiple pixel circuits.

FIG. 10 is a block diagram of a section of a display system arranged to share a common programming capacitor 734 and reset capacitor 734 between multiple pixel circuits 710*a-n*. The pixel circuits 710*a-n* can be pixel circuits in a single column of the display panel that share the data line 22*j* and share the common programming capacitor 734. The pixel circuits 710*a-n* can be in more than one row of the display panel, and can optionally be adjacent rows, such as the adjacent rows from the "ith" row the "(i+n)th" row. Each of the pixel circuits 710*a-n* can be similar to the pixel circuit 610' shown in FIG. 9A or the pixel circuit 610" shown in FIG. 9B and operated according to a segmented second select line 24*k* ("SEL2[k]"), a segmented emission control line 25*k* ("EM[k]"), and the segmented reset line 21*k* ("RST [k]"). Thus, each of the pixel circuits 710*a-n* can include a drive transistor connected in series with an emission control transistor and light emitting device, a storage capacitor connected to the gate terminal of the drive transistor, a first switch transistor to selectively the gate terminal of the drive transistor to the programming capacitor 734, and a second switch transistor to selectively connect the gate terminal of the drive transistor to a current path through the drive transistor. However, each of the pixel circuits 710*a-n* share the common programming capacitor 730 and common reset capacitor 734. The emission control transistors and second switch transistors in each of the pixel circuits 710*a-n* can be simultaneously operated by the segmented second select line 24*k* and segmented emission control line 25*k*, respectively. The reset capacitor 734 can also be operated via the segmented reset line 21*k* to simultaneously reset the gate terminals of the drive transistors in the pixel circuits 710*a-n* during the compensation cycle. As a result, compensation cycles can be implemented simultaneously on each of the pixel circuits 710*a-n* in the "kth" segment by operating the segmented control lines 24*k*, 25*k* and applying a ramp voltage on the data line 22*j* such that a current is conveyed through each of the pixel circuits 710*a-n* according to the time changing voltage on the common programming capacitor 730.

In addition, each of the pixel circuits 710*a-n* are connected to first select lines that are individually controlled to operate the first switch transistors in each pixel circuit 710*a-n* to be charged according to programming information one row at a time. In some examples, the programming can start with the pixel circuit 710*a*, in the "ith" row and proceed through each row in the segment to the pixel circuit 710*n* in the "(i+n)th" row. While the "ith" row is programmed, the first select line for the "ith" row can be low while the rest of the first select lines for the "kth" segment are high such that the common programming capacitor 730 is connected only to the pixel circuit 710*a*. Once programming for the "ith" row is complete, the first select line for the "ith" row can be set high and the first select line for the "(i+1)th" row can be set low to program the pixel circuit 710*b* in the "(i+1)th" row. In other examples, all of the first select lines can be set low during the programming of the "ith" row, such that all of the pixel circuits 710*a-n* receive the programming information for the "ith" row. Once programming for the "ith" row is complete, the first select line for the "ith" row is set high to disconnect the pixel circuit 710*a* from the data line 22*j* and the data line 22*j* is updated with the programming information for the "(i+1)th" row and the remainder of the pixel circuits 710*b*-710*n* in the "kth" receive the programming information for the "(i+1)th" row. Because the pixel circuits 710*b*-710*n* are floating (due to the second switch transistor 626 being turned off), the pixel circuits 710*b*-710*n* retain only the most recently applied programming information. The pixel circuit 710*b* is then disconnected by setting the first select line for the "(i+1)th" row high and the storage capacitor of the pixel circuit 710*b* is set according to the programming information for the "(i+1)th" row. Each row can be disconnected from the data line 22*j* one row at a time once it receives the proper programming information until all of the pixel circuits 710*a-n* are programmed.

The voltage change achieved at the reset node (i.e., the gate terminal of the drive transistors 512, 612 in FIGS. 6A-9B) can be determined according to Equation 3 below.

$$\Delta V=(C_{RST}/(C_{RST}+C_{TOTAL}))(V\text{off}-V\text{on}) \quad (3)$$

In Equation 3, ΔV is the change in voltage at the gate terminal of the drive transistor caused by the reset capacitor, $C_{TOTAL}$ is the total effective capacitance at the node being reset (i.e., the gate terminal of the drive transistor), and can be determined based on the capacitance of the light emitting device (e.g., $C_{OLED}$ 515 in the pixel circuit 510), the capacitance of any storage and/or programming capacitors coupled to the gate terminal of the drive transistor (e.g., the storage capacitor 616 and programming capacitor 630 in the pixel circuit 610), and any other capacitive elements coupled to the reset node simultaneously with the reset capacitor. Von is the on voltage of the select line 24*i* and Voff is the off voltage of the select line 24*i*, and the difference between the two (i.e., Voff−Von) is the voltage drop applied to one side of the reset capacitor. In the example of FIGS. 9A and 9B, Voff−Von is the difference between the high and low voltages of the reset line 21*k*.

The voltage to be established at the reset node (i.e., the gate terminal of the drive transistor) can be expressed as $V_{RESET}$ and determined according to a combination of $V_{MAX}$ and ΔV, where ΔV is given by Equation 3 and $V_{MAX}$ is the maximum possible voltage at the reset node (i.e., the gate terminal of the drive transistor). The value of VMAX is thus a function of the range of programming voltages applied and/or compensation voltages developed at the gate terminal of the drive transistor during the programming and/or compensation of the pixel circuits at FIGS. 6A-9B. The relation for $V_{RESET}$ can depend, at least in part on the type of pixel circuit employed, and whether the drive transistor is an n-type TFT or a p-type TFT. In some pixel circuits, $V_{RESET}>V_{MAX}-|\Delta V|$. In other pixel circuits $V_{RESET}<V_{MAX}+|\Delta V|$. For example, where the drive transistor (e.g., the transistor 512 or 612) is a p-type TFT, the capacitance of the reset capacitor 532 (i.e., the value of $C_{RST}$) and/or the values of Voff and Von can be configured such that $V_{RESET}>V_{MAX}|\Delta V|$. In another example, where the drive transistor is an n-type TFT (and the pixel circuit may be configured as a complementary circuit to one of the pixel circuits shown in FIGS. 5A-9B), the capacitance of the reset capacitor 532 (i.e., the value of CRST), the values of Voff and Von, and/or other configurable values in the pixel design and operation can be configured such that $V_{RESET}<V_{MAX}+|\Delta V|$.

In some embodiments of the present disclosure the reset capacitors 532, 632, 634 disclosed herein can be created by arranging conductive elements to increase an existing line capacitance between the select line 24*i* (or another line) and the gate terminal of the drive transistor 512, 612. Such an arrangement can provide the increase in line capacitance so as to be separated from the gate terminal of the drive transistor 512, 612 through a switch transistor (e.g., 526, 626) such that the capacitive coupling effect can be regulated via the switch transistor.

Circuits disclosed herein generally refer to circuit components being connected or coupled to one another. In many instances, the connections referred to are made via direct connections, i.e., with no circuit elements between the connection points other than conductive lines. Although not always explicitly mentioned, such connections can be made by conductive channels defined on substrates of a display panel such as by conductive transparent oxides deposited between the various connection points. Indium tin oxide is one such conductive transparent oxide. In some instances, the components that are coupled and/or connected may be coupled via capacitive coupling between the points of connection, such that the points of connection are connected in series through a capacitive element. While not directly connected, such capacitively coupled connections still allow the points of connection to influence one another via changes in voltage which are reflected at the other point of connection via the capacitive coupling effects and without a DC bias.

Furthermore, in some instances, the various connections and couplings described herein can be achieved through non-direct connections, with another circuit element between the two points of connection. Generally, the one or more circuit element disposed between the points of connection can be a diode, a resistor, a transistor, a switch, etc. Where connections are non-direct, the voltage and/or current between the two points of connection are sufficiently related, via the connecting circuit elements, to be related such that the two points of connection can influence each another (via voltage changes, current changes, etc.) while still achieving substantially the same functions as described herein. In some examples, voltages and/or current levels may be adjusted to account for additional circuit elements providing non-direct connections, as can be appreciated by individuals skilled in the art of circuit design.

Any of the circuits disclosed herein can be fabricated according to many different fabrication technologies, including for example, poly-silicon, amorphous silicon, organic semiconductor, metal oxide, and conventional CMOS. Any of the circuits disclosed herein can be modified by their complementary circuit architecture counterpart (e.g., n-type transistors can be converted to p-type transistors and vice versa).

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the scope of the invention as defined in the appended claims.

What is claimed is:

1. A pixel circuit connectable to a data line and a reset line comprising:

a drive transistor including a gate terminal configured to convey a drive current through a light emitting device during emission cycles, the drive current being conveyed according to a voltage on the gate terminal of the drive transistor;

a storage capacitor connected to the gate terminal of the drive transistor for storing programming voltages conveyed via the data line during programming and/or compensation cycles;

a first switch transistor connected between the gate terminal of the drive transistor and a first terminal of the drive transistor between the drive transistor and the light emitting device;

a first select line connected to a gate terminal of the first switch transistor for conveying a signal to turn on the first switch transistor; and a reset capacitor connected between the first terminal of the drive transistor and the reset line such that the reset line is capacitively coupled to the gate terminal of the drive transistor, while the first switch transistor is turned on, and configured to generate a change in voltage at the gate terminal of the drive transistor based on the storage and reset capacitors for resetting the drive transistor between programming cycles.

2. The pixel circuit according to claim 1, wherein the first switch transistor is connected to the first select line such that turning on the first switch transistor by adjusting the voltage on the first select line simultaneously generates a change in voltage at the gate terminal of the drive transistor.

3. The pixel circuit according to claim 1, further comprising an emission control transistor between the drive transistor and the light emitting device; wherein the emission control transistor is configured to turn off prior to programming the pixel circuit, such that the voltage of the light emitting device discharges to an off voltage.

4. The pixel circuit according to claim 1, wherein a first terminal of the storage capacitor is connected to the gate terminal of the drive transistor, and a second terminal of the storage capacitor connected to a stable voltage to allow the storage capacitor to be charged according to programming information.

5. The pixel circuit according to claim 1, wherein a first terminal of the storage capacitor is connected to the gate terminal of the drive transistor, and a second terminal of the storage capacitor is connected to a power supply line.

6. The pixel circuit according to claim 1, wherein the light emitting device is an organic light emitting diode.

7. The pixel circuit according to claim 1, wherein the drive transistor is an n-type or p-type thin film transistor.

8. The pixel circuit according to claim 1, further comprising: a feedback capacitor connected between the light emitting device and the gate terminal of the drive transistor such that voltage change across the light emitting device generates a corresponding voltage change at the gate terminal of the drive transistor.

9. The pixel circuit according to claim 8, wherein in response to an increase in the voltage at the light emitting device caused by an increase in current through the light emitting device, the feedback capacitor is configured to generate a corresponding voltage decrease at the gate terminal of the drive transistor to cause the current through the drive transistor to decrease.

10. The pixel circuit according to claim 8, wherein in response to a decrease in the voltage at the light emitting device caused by a decrease in current through the light emitting device, the feedback capacitor is configured to generate a corresponding voltage increase at the gate terminal of the drive transistor to cause the current through the drive transistor to increase.

11. The pixel circuit according to claim 8, wherein the voltage changes at the gate terminal of the drive transistor generated by the feedback capacitor are generated according to a voltage division relationship between the storage capacitor and the feedback capacitor.

12. The pixel circuit according to claim 1, further comprising: a switching circuit connected to a second select line configured to selectively couple the gate terminal of the drive transistor to the data line for charging the storage capacitor and programming the pixel circuit according to programming information.

13. The pixel circuit according to claim 12, wherein the switching circuit includes a second switch transistor connected to the second select line configured to selectively connect the gate terminal of the drive transistor to the data line.

14. The pixel circuit according to claim 13, wherein the switching circuit further includes a programming capacitor; and wherein the second switch transistor is configured to selectively coupling the gate terminal of the drive transistor to the data line via the programming capacitor.

15. The pixel circuit according to claim 14, wherein the gate terminal of the drive transistor is capacitively coupled to the data line via the programming capacitor, such that while the first switch transistor and the second switch transistor are turned on and a ramp voltage is applied to the data line, a conveyed current is conveyed through the programming capacitor and the second switch transistor, whereby the gate terminal of the drive transistor adjusts according to the conveyed current to account for aging degradations in the drive transistor.

16. A display system including:

a plurality of pixel circuits arranged in rows and/or columns, the plurality of pixel circuits connected to a data line and a reset line, each of the plurality of pixel circuits including:

a light emitting device for emitting light during emission cycles;

a drive transistor including a gate terminal configured to convey a drive current through the light emitting device during the emission cycles, the drive current being conveyed according to a voltage on the gate terminal of the drive transistor;

a first switch transistor connected between the gate terminal of the drive transistor and a first terminal of the drive transistor between the drive transistor and the light emitting device; and a first select line connected to a gate terminal of the first switch transistor for conveying a signal to turn on the first switch transistor;

a common storage capacitor connected to the gate terminals of each of the drive transistors for storing programming voltages conveyed via the data line during programming and/or compensation cycles;

a common reset capacitor connected between the first terminals of each of the drive transistors and the reset line, such that the reset line is capacitively coupled to the gate terminals of each of the drive transistors, while the first switch transistors are turned on, and configured to generate a change in voltage at the gate terminals of each of the drive transistors based on the storage and reset capacitors for resetting each of the drive transistors between programming cycles.

17. The display according to claim 16, further comprising: a feedback capacitor connected between the light emitting device and the gate terminal of the drive transistor such that voltage changes across the light emitting device generate corresponding voltage changes at the gate terminal of the drive transistor.

18. The display according to claim 16, further comprising: a switching circuit connected to a second select line configured to selectively couple the gate terminal of the drive transistor to the data line for charging the storage capacitor and programming the pixel circuit according to programming information.

19. The display according to claim 18, wherein the switching circuit includes a second switch transistor connected to the second select line configured to selectively connect the gate terminal of the drive transistor to the data line.

20. The display according to claim 19, wherein the switching circuit further includes a programming capacitor; and wherein the second switch transistor is configured to selectively coupling the gate terminal of the drive transistor to the data line via the programming capacitor.

* * * * *